US009970081B2

(12) United States Patent
Oishi et al.

(10) Patent No.: US 9,970,081 B2
(45) Date of Patent: May 15, 2018

(54) COPPER ALLOY AND COPPER ALLOY SHEET

(71) Applicant: MITSUBISHI SHINDOH CO., LTD., Tokyo (JP)

(72) Inventors: Keiichiro Oishi, Osaka (JP); Yosuke Nakasato, Kitamoto (JP); Takashi Hokazono, Osaka (JP)

(73) Assignee: MITSUBISHI SHINDOH CO., LTD., Tokyo (JP)

( * ) Notice: Subject to any disclaimer, the term of this patent is extended or adjusted under 35 U.S.C. 154(b) by 0 days. days.

(21) Appl. No.: 15/021,012

(22) PCT Filed: Sep. 26, 2014

(86) PCT No.: PCT/JP2014/075705
§ 371 (c)(1),
(2) Date: Mar. 10, 2016

(87) PCT Pub. No.: WO2015/046459
PCT Pub. Date: Apr. 2, 2015

(65) Prior Publication Data

US 2016/0222489 A1 Aug. 4, 2016

(30) Foreign Application Priority Data

Sep. 26, 2013 (JP) ..... 2013-199475
Feb. 28, 2014 (JP) ..... 2014-039678

(51) Int. Cl.

| | |
|---|---|
| ***C22C 9/04*** | (2006.01) |
| ***C22F 1/00*** | (2006.01) |
| ***C22F 1/08*** | (2006.01) |
| ***B22D 21/00*** | (2006.01) |
| ***C21D 8/02*** | (2006.01) |
| ***C21D 9/46*** | (2006.01) |

(52) U.S. Cl.
CPC ..... *C22C 9/04* (2013.01); *B22D 21/005* (2013.01); *C21D 8/0236* (2013.01); *C21D 8/0273* (2013.01); *C21D 9/46* (2013.01); *C22F 1/00* (2013.01); *C22F 1/08* (2013.01)

(58) Field of Classification Search
CPC ..... C22C 9/04; C22F 1/08
See application file for complete search history.

(56) References Cited

U.S. PATENT DOCUMENTS

| | | | | |
|---|---|---|---|---|
| 6,471,792 | B1 | 10/2002 | Breedis et al. | |
| 9,017,491 | B2 | 4/2015 | Oishi et al. | |
| 2014/0112822 | A1 | 4/2014 | Tanaka et al. | |
| 2014/0193292 | A1 * | 7/2014 | Oishi | C22C 9/04 420/472 |
| 2014/0234156 | A1 | 8/2014 | Uchida | |
| 2016/0201180 | A1 | 7/2016 | Oishi et al. | |

FOREIGN PATENT DOCUMENTS

| | | | | |
|---|---|---|---|---|
| CA | 2687452 | A1 | 5/2011 | |
| CA | 2842488 | A1 | 2/2013 | |
| CA | 2844247 | A1 | 3/2013 | |
| JP | H05-311294 | A | 11/1993 | |
| JP | H05311292 | A | 11/1993 | |
| JP | 06-228684 | A | 8/1994 | |
| JP | 10-265874 | A | 10/1998 | |
| JP | 11-239603 | | 9/1999 | |
| JP | 2004-143574 | A | 5/2004 | |
| JP | 2006-283060 | A | 10/2006 | |
| JP | 2007-056365 | A | 3/2007 | |
| JP | 2007-211317 | A | 8/2007 | |
| JP | 2007332466 | A | 12/2007 | |
| JP | 5245015 | B1 | 7/2013 | |
| KR | 10-2016-0040313 | A | 4/2016 | |
| TW | 200722536 | A1 | 6/2007 | |
| TW | 201229259 | A1 | 7/2012 | |
| WO | WO 2013042678 | A1 * | 3/2013 | C22C 9/04 |
| WO | 2013/115363 | A1 | 8/2013 | |

OTHER PUBLICATIONS

U.S. Office Action issued with respect to U.S. Appl. No. 15/024,500, dated Sep. 8, 2016.
U.S. Office Action issued with respect to U.S. Appl. No. 15/024,500, dated Jun. 30, 2016.
Korean Office Action issued with respect to application No. 10-2016-7005904, dated Jul. 18, 2016.
Canadian Office Action issued with respect to application No. 2,922,455, dated Jul. 11, 2016.
Taiwanese Office Action issued with respect to application No. 103133607, dated Jul. 15, 2015.
Japanese Office Action issued with respect to application No. 2015-539378, dated Oct. 27, 2015.
International Search Report issued with respect to application No. PCT/JP2014/075612, dated Jan. 6, 2015.
International Preliminary Report on Patentability issued with respect to application No. PCT/JP2014/075612, dated Mar. 29, 2016.
Japanese Office Action issued with respect to application No. 2015-508346, dated May 26, 2015.
Japanese Office Action issued with respect to application No. 2015-508346, dated Aug. 4, 2015.
Japanese Office Action issued with respect to application No. 2015-508346, dated Dec. 8, 2015.
Japanese Notice of Allowance issued with respect to application No. 2015-508346, dated Apr. 5, 2016.
Canadian Office Action issued with respect to application No. 2,923,462, dated Apr. 26, 2016.
U.S. Office Action issued with respect to U.S. Appl. No. 15/066,093, dated Feb. 22, 2017.

(Continued)

*Primary Examiner* — Christopher Kessler
(74) *Attorney, Agent, or Firm* — Greenblum & Bernstein, P.L.C.

(57) ABSTRACT

Provided is a copper alloy containing 18% by mass to 30% by mass of Zn, 1% by mass to 1.5% by mass of Ni, 0.2% by mass to 1% by mass of Sn, and 0.003% by mass to 0.06% by mass of P, the remainder including Cu and unavoidable impurities. Relationships of $17 \leq f1 = [Zn] + 5 \times [Sn] - 2 \times [Ni] \leq 30$, $14 \leq f2 = [Zn] - 0.5 \times [Sn] - 3 \times [Ni] \leq 26$, $8 \leq f3 = \{f1 \times (32 - f1)\}^{1/2} \times [Ni] \leq 23$, $1.3 \leq [Ni] + [Sn] \leq 2.4$, $1.5 \leq [Ni]/[Sn] \leq 5.5$, and $20 \leq [Ni]/[P] \leq 400$ are satisfied. The copper alloy has a metallographic structure of an α single phase.

9 Claims, No Drawings

(56) References Cited

OTHER PUBLICATIONS

A.P. Miodownik, "Cu—Zn (Copper—Zinc), Phase Diagrams of Binary Copper Alloys", P.R. Subramanian, D.J. Chakrabarti and D.E. Laughlin, Ed. ASM International, 1994, pp. 487-496.

Mexican Office Action issued with respect to Application No. MX/a/2016/003813, dated Apr. 17, 2017, 11 pages.

Mexican Office Action issued with respect to Application No. MX/a/2016/003814, dated Apr. 17, 2017, 13 pages.

U.S. Office Action issued with respect to U.S. Appl. No. 15/066,093, dated Dec. 28, 2017.

* cited by examiner

COPPER ALLOY AND COPPER ALLOY SHEET

TECHNICAL FIELD

The present invention relates to a copper alloy which appears brass yellow, has excellent stress corrosion cracking resistance and discoloration resistance, and is excellent in stress relaxation characteristics, and a copper alloy sheet formed from the copper alloy.

Priority is claimed on Japanese Patent Application No. 2013-199475, filed Sep. 26, 2013, and Japanese Patent Application No. 2014-039678, filed Feb. 28, 2014, the contents of which are incorporated herein by reference.

BACKGROUND ART

In the related art, a copper alloy such as Cu—Zn has been used for various uses such as a connector, a terminal, a relay, a spring, and a switch which are constituent parts of an electric and electronic apparatuses, a construction material, daily necessities, and a mechanical part. In the connector, the terminal, the relay, the spring, and the like, a copper alloy raw material may be used as is, but plating of Sn, Ni, and the like may be carried out due to discoloration and a corrosion problem such as stress corrosion cracking. Further, even in a use for a metal fitting or a member for decoration and construction such as a handrail and a door handle, and a use for a medical instrument, it is demanded for the discoloration to be less likely to occur. To cope with the demand, a plating treatment such as nickel and chromium plating, resin coating, clear coating, or the like is carried out with respect the copper alloy product so as to cover a surface of the copper alloy with the resultant plating or coating.

However, in the plated product, a plating layer on the surface is peeled off due to use for a long period of time. In addition, in a case of manufacturing a large quantity of products such as connectors or terminals at a low cost, in a process of manufacturing a sheet that becomes a raw material of the products, plating of Sn, Ni, and the like is carried out in advance on a sheet surface, and the sheet material may be punched and used. Plating is not formed on a punched surface, and thus discoloration or stress corrosion cracking is likely to occur. In addition, Sn or Ni is contained in the plating and the like, and recycling of the copper alloy becomes difficult. In addition, the coated product has a problem in that a color tone varies with the passage of time, and a coated film is peeled off. In addition, the plated product and the coated product deteriorate antimicrobial properties (sterilizing properties) of the copper alloy. In consideration of the above-described situation, a copper alloy, which is excellent in the discoloration resistance and the stress corrosion cracking resistance and which can be used without plating, is preferable.

Examples of a use environment when assuming a terminal, a connector, and a handrail include a high-temperature or high-humidity indoor environment, a stress corrosion cracking environment containing a slight amount of nitrogen compound such as ammonia and amine, a high-temperature environment such as approximately 100° C. when being used at the inside of automobiles under the blazing sun or a portion close to an engine room, and the like. To endure the environment, it is preferable that the discoloration resistance and the stress corrosion cracking resistance are excellent. The discoloration has a great effect on not only exterior appearance but also antimicrobial properties or conductivity of copper. A handrail, a door handle, a connector, or a terminal that is not subjected to plating, a connector or a terminal and a door handle in which a punching end surface is exposed, and the like have been used widely, and thus there is a demand for a copper alloy material having excellent discoloration resistance, and stress corrosion cracking resistance. On the other hand, high material strength is necessary in a case where a reduction in thickness of a material is demanded, and is necessary to obtain a high contact pressure when being used for a terminal or a connector. When the copper alloy material is used for a terminal, a connector, a relay, a spring, and the like, the high material strength is used as a stress that is equal to or less than an elastic limit of the material at room temperature. However, as a temperature in a use environment of the material becomes higher, for example, as the temperature becomes as high as 90° C. to 150° C., the copper alloy is permanently deformed, and thus it is difficult to obtain a predetermined contact pressure. To utilize high strength, it is preferable that the permanent deformation is small at a high temperature, and it is preferable that the stress relaxation characteristics, which are used as a criterion of the permanent deformation at a high temperature, are excellent.

In addition, as a constituent material of an electrical part, an electronic part, an automobile part, and a connector, a terminal, a relay, a spring, and a switch which are used in a communication apparatus, an electronic apparatus, an electrical apparatus, and the like, a highly conductive copper alloy with high strength has been used. However, recently, along with a reduction in size, a reduction in weight, and higher performance of the apparatuses, the constituent material that is used for the apparatuses is demanded to cope with a very strict characteristic improvement, or various use environments. Further, excellent cost performance is demanded for the constituent material. For example, a thin sheet is used at a spring contact portion of the connector, and a high-strength copper alloy, which constitutes the thin sheet, is demanded to have high strength, high balance between strength and elongation or bending workability for realization of a reduction in thickness, and discoloration resistance, stress corrosion cracking resistance, and stress relaxation characteristics for endurance against a use environment. In addition, the high-strength copper alloy is demanded to have high productivity, and excellent cost performance, particularly, by suppressing an amount of a noble metal copper that is used as much as possible.

Examples of the high-strength copper alloy include phosphorus bronze that contains Cu, 5% by mass or greater of Sn, and a slight amount of P, and nickel silver that contains a Cu—Zn alloy and 10% by mass to 18% by mass of Ni. As a general-purpose high-conductivity and high-strength copper alloy excellent in cost performance, brass, which is an alloy of Cu and Zn, is typically known.

In addition, for example, Patent Document 1 discloses a Cu—Zn—Sn alloy as an alloy satisfying the demand for high strength.

RELATED ART DOCUMENT

Patent Document

Patent Document 1: Japanese Unexamined Patent Application Publication No. 2007-056365

DISCLOSURE OF THE INVENTION

Problem that the Invention is to Solve

However, the typical high-strength copper alloys such as phosphorus bronze, nick silver, and brass, which are described above, have the following problems, and thus it is difficult to cope with the above-described demand.

The phosphorus bronze and the nickel silver are poor in hot workability, and thus it is difficult to manufacture the phosphorus bronze and the nickel silver through hot-rolling. Therefore, the phosphorus bronze and the nickel silver are manufactured through horizontal continuous casting. Accordingly, productivity deteriorates, the energy cost is high, and a yield ratio also deteriorates. In addition, the phosphorus bronze or the nickel silver, which is a representative kind with high strength, contains a large amount of copper that is a novel metal, or contains a large amount of Sn and Ni which are more expensive than copper, and thus there is a problem relating to economic efficiency. In addition, the specific gravity of these alloys is as high as approximately 8.8, and thus there is also a problem relating to a reduction in weight. In addition, the strength and the conductivity are contradictory characteristics, and as the strength is improved, the conductivity typically decreases. The nickel silver that contains 10% by mass or greater of Ni, or the phosphorus bronze that does not contain Zn and contains 5% by mass or greater of Sn has high strength. However, the nickel silver has conductivity as low as less than 10% IACS, and the phosphorous bronze has conductivity as low as less than 16% IACS, and thus there is a problem in practical use.

Zn, which is a main element of the brass alloy, is cheaper than Cu. In addition, when Zn is contained, a density decreases, and strength, that is, tensile strength, a proof stress or a yield stress, a spring deflection limit, and fatigue strength increase.

On the other hand, in the brass, when a Zn content increases, the stress corrosion cracking resistance deteriorates, and when the Zn content is greater than 15% by mass, a problem starts to occur. When the Zn content is greater than 20% by mass, and as the Zn content is greater than 25% by mass, the stress corrosion cracking resistance deteriorates. In addition, the Zn content reaches 30% by mass, susceptibility to the stress corrosion cracking greatly increases, and thus a serious problem is caused. When the amount of Zn that is added is set to 5% by mass to 15% by mass, the stress relaxation characteristics that indicates heat resistance are improved at once, but as the Zn content is greater than 20% by mass, the stress relaxation characteristics rapidly deteriorate, and particularly, when the Zn content becomes 25% by mass or more, the stress relaxation characteristics become very deficient. In addition, as the Zn content increases, the strength is improved, but ductility and bending workability deteriorate, and a balance between the strength and the ductility deteriorates. In addition, the discoloration resistance is deficient regardless of the Zn content, and when a use environment is bad, discoloration into brown or red occurs.

As described above, brass of the related art is excellent in the cost performance. However, it cannot be said that the brass of the related art is a copper alloy, which is appropriate for a constituent material of electronic and electrical apparatuses, and an automobile, a decoration member such as a door handle, or a construction member in which a reduction in size and higher performance are desired, from the viewpoints of the stress corrosion cracking resistance, the stress relaxation characteristics, the balance between the strength and the ductility, and the discoloration resistance.

Accordingly, a high-strength copper alloy such as the phosphorus bronze, the nickel silver, and the brass of the related art is excellent in the cost performance and is appropriate for various use environments, and plating may be partially omitted. However, the high-strength copper alloy is not satisfactory as a constituent material of parts of various apparatuses such as an electronic apparatus, an electrical apparatus, and an automobile, and a member for decoration and construction which has a tendency of a reduction in size and weight, and higher performance. Accordingly, there is a strong demand for development of a new high-strength copper alloy.

In addition, even in the Cu—Zn—Sn alloy described in Patent Document 1, all characteristics including the strength are not sufficient.

The invention has been made to solve the problems in the related art, and an object thereof is to provide a copper alloy which is excellent in the cost performance that is an advantage of the brass in the related art, which has a small density, conductivity greater than that of phosphorus bronze or nickel silver, and high strength, which is excellent in a balance between strength, elongation, bending workability, and conductivity, stress relaxation characteristics, stress corrosion cracking resistance, discoloration resistance, and antimicrobial properties, and which is capable of coping with various use environments, and a copper alloy sheet that is formed from the copper alloy.

Solution to Problem

The present inventors have made a thorough investigation, and various research and experiments in various aspects to solve the above-described problems as follows. Specifically, first, appropriate amounts of Ni and Sn are added to a Cu—Zn alloy that contains Zn in a concentration as high as 18% by mass to 30% by mass. In addition, a total content of Ni and Sn, and a content ratio of Ni and Sn are set in an appropriate range so as to optimize a mutual operation of Ni and Sn. In addition, three relational expressions of $f1=[Zn]+5\times[Sn]-2\times[Ni]$, $f2=[Zn]-0.5\times[Sn]-3\times[Ni]$, and $f3=\{f1\times(32-f1)\}^{1/2}\times[Ni]$ are established to obtain appropriate values, respectively, Zn, Ni, and Sn are adjusted, and an amount of P and an amount of Ni are set to content ratios in appropriate range in consideration of the mutual operation between Zn, Ni, and Sn. In addition, a metallographic structure of a matrix is substantially set to a single phase of α-phase, and a grain size of the α-phase is appropriately adjusted. According to this, the present inventors have found a copper alloy which is excellent in cost performance, which has a small density and high strength, which is excellent in a balance between elongation, bending workability, and conductivity, stress relaxation characteristics, stress corrosion cracking resistance, and discoloration resistance, and which is capable of coping with various use environments, and they accomplished the invention.

Specifically, when appropriate amounts of Zn, Ni, and Sn are solid-soluted in a matrix, and P is contained, high strength is obtained without damaging ductility and bending workability. In addition, Sn having an atomic valence of four (the number of valence electrons is four, the same shall apply hereinafter), Zn and Ni which have an atomic valence of two, and P having an atomic valence of five are co-added, the discoloration resistance, the stress corrosion cracking resistance, and the stress relaxation characteristics are improved, and a stacking-fault energy of an alloy is lowered, and thus grains are made fine during recrystallization. In addition, when P is added, an effect of retaining recrystallized grains in a fine state is attained, and a fine compound including Ni and P as a main component is formed. Accordingly, grain growth is suppressed and thus the grains are retained in a fine state.

When respective elements of Zn, Ni, and Sn are solid-soluted in Cu, the discoloration resistance, the stress corrosion cracking resistance, and the stress relaxation characteristics are improved. In addition, it is necessary to consider properties of the respective elements including Zn, Ni, and Sn and a mutual operation between the elements from various viewpoints so as to improve the strength without damaging the ductility and the bending workability. That is, it is difficult to always attain the above-described advantages in that the discoloration resistance, the stress corrosion cracking resistance, and the stress relaxation characteristics are improved, and the high strength is obtained without damaging the ductility and the bending workability only with a configuration in which the respective elements are simply contained in specific ranges, that is, 18% by mass to 30% by mass of Zn, 1% by mass to 1.5% by mass of Ni, and 0.2% by mass to 1% by mass of Sn are contained.

Accordingly, it is necessary to satisfy three relational expressions including $17 \leq f1 = [Zn] + 5 \times [Sn] - 2 \times [Ni] \leq 30$, $14 \leq f2 = [Zn] - 0.5 \times [Sn] - 3 \times [Ni] \leq 26$, and 8 $f3 = \{f1 \times (32-f1)\}^{1/2} \times [Ni] \leq 23$.

Even in a case where the mutual operation of the respective elements including Zn, Ni, and Sn is considered, the lower limits of the relational expressions f1 and f2, and the upper limit of the relational expression f3 are minimum necessary values so as to obtain high strength. On the other hand, when values of the relational expressions f1 and f2 are greater than the upper limits, or the value of the relational expression f3 is less than the lower limit, the strength increases, but the ductility and the bending workability are damaged, and thus the stress relaxation characteristics or the stress corrosion cracking resistance deteriorates.

The upper limit of the relational expression f1: $=[Zn] + 5 \times [Sn] - 2 \times [Ni]$ is a value determining whether or not the metallographic structure of the alloy of the invention is substantially constituted by only the α-phase, and is a boundary value for obtaining the ductility and the bending workability which are satisfactory. When 1% by mass to 1.5% by mass of Ni and 0.2% by mass to 1% by mass of Sn are contained in an alloy of Cu and 18% by mass to 30% by mass of Zn, a β-phase and a γ-phase may exist in a non-equilibrium state. When the β-phase and the γ-phase exist, the ductility and the bending workability are damaged, and the discoloration resistance, the stress corrosion cracking resistance, and the stress relaxation characteristics deteriorate.

However, an α single phase represents a phase in which the β-phase and the γ-phase other than a non-metallic inclusion such as an oxide that occurs during melting, and an intermetallic compound such as a crystallized product and a precipitate are not clearly observed in a matrix when observing a metallographic structure with a metallographic microscope at a magnification of 300 times after performing etching by using a mixed solution of aqueous ammonia and hydrogen peroxide. However, during observation with the metallographic microscope, the α-phase appears light yellow, the β-phase appears yellow deeper than that of the α-phase, the γ-phase appears light blue, the oxide and the non-metallic inclusion color gray, and the metallic compound appears light blue that is more bluish than that of the γ-phase, or appears blue. In the invention, the substantial α single phase represents that when observing the metallographic structure with the metallographic microscope at a magnification of 300 times, the percentage of the α-phase in the metallographic structure other than the non-metallic inclusion including an oxide, and the intermetallic compound such as the precipitate and the crystallized product is 100%.

The upper limit of the relational expression f2: $[Zn] - 0.5 \times [Sn] - 3 \times [Ni]$ is a boundary value for obtaining the stress corrosion cracking resistance, the ductility, and the bending workability which are satisfactory. As described above, examples of a fatal defect of the Cu—Zn alloy include high susceptibility to the stress corrosion cracking. However, in a case of the Cu—Zn alloy, the susceptibility to the stress corrosion cracking depends on a Zn content, and when the Zn content is greater than 25% by mass or 26% by mass, particularly, the susceptibility to the stress corrosion cracking increases. The upper limit of the relational expression f2 corresponds to the Zn content of 25% by mass or 26% by mass, is a boundary value of the stress corrosion cracking, and is a boundary value for obtaining the ductility and the bending workability.

The lower limit of the relational expression f3: $\{f1 \times (32-f1)\}^{1/2} \times [Ni]$ is a boundary value for obtaining the satisfactory stress relaxation characteristics. As described above, the Cu—Zn alloy is an alloy excellent in the cost performance, but is lack of the stress relaxation characteristics. Accordingly, despite having high strength, it is difficult to make use of the high strength. In order to improve stress relaxation in the Cu—Zn alloy, co-addition of 1% by mass to 1.5% by mass of Ni and 0.2% by mass to 1% by mass of Sn is a primary condition, and a total content of Ni and Sn, and content ratios of Ni and Sn are important. Although details will be described later, at least 3 or more Ni atoms are necessary for one Sn atom. In addition, with regard to an expression indicating a metallographic structure, when the product of the square root of the product of $f1 = [Zn] + 5 \times [Sn] - 2 \times [Ni]$, which is the present relational expression adjusting the Zn content, and $(32-f1)$, and Ni is equal to or greater than the lower limit, the stress relaxation characteristics are improved.

The above-described limitation is still insufficient for an improvement in the stress relaxation characteristics of the Cu—Zn alloy. It is necessary for P to be contained, and it is important to satisfy content ratios of Ni and P.

The present inventors have found that when the total content of Ni and Sn is equal to or greater than a predetermined value in addition to the content ratios of Ni and Sn, the discoloration resistance of the Cu—Zn alloy is improved.

According to a first aspect of the invention, there is provided a copper alloy containing 18% by mass to 30% by mass of Zn, 1% by mass to 1.5% by mass of Ni, 0.2% by mass to 1% by mass of Sn, and 0.003% by mass to 0.06% by mass of P, the remainder including Cu and unavoidable impurities. A Zn content [Zn] in terms of % by mass, a Sn content [Sn] in terms of % by mass, and a Ni content [Ni] in terms of % by mass satisfy relationships of $17 \leq f1 = [Zn] + 5 \times [Sn] - 2 \times [Ni] \leq 30$, $14 \leq f2 = [Zn] - 0.5 \times [Sn] - 3 \times [Ni] \leq 26$, and 8 $f3 = \{f1 \times (32-f1)\}^{1/2} \times [Ni] \leq 23$. The Sn content [Sn] in terms of % by mass, and the Ni content [Ni] in terms of % by mass satisfy relationships of $1.3 \leq [Ni] + [Sn] \leq 2.4$, and $1.5 \leq [Ni]/[Sn] \leq 5.5$. The Ni content [Ni] in terms of % by mass, and a P content [P] in terms of % by mass satisfy a relationship of $20 \leq [Ni]/[P] \leq 400$. The copper alloy has a metallographic structure of an α single phase.

According to a second aspect of the invention, there is provided a copper alloy containing 19% by mass to 29% by mass of Zn, 1% by mass to 1.5% by mass of Ni, 0.3% by mass to 1% by mass of Sn, and 0.005% by mass to 0.06% by mass of P, the remainder including Cu and unavoidable impurities. A Zn content [Zn] in terms of % by mass, a Sn content [Sn] in terms of % by mass, and a Ni content [Ni] in terms of % by mass satisfy relationships of $18 \leq f1 = [Zn] + 5 \times [Sn] - 2 \times [Ni] \leq 30$, $15 \leq f2 = [Zn] - 0.5 \times [Sn] - 3 \times [Ni] \leq 25.5$, and $9 \leq f3 = \{f1 \times (32 - f1)\}^{1/2} \times [Ni] \leq 22$. The Sn content [Sn] in terms of % by mass, and the Ni content [Ni] in terms of % by mass satisfy relationships of $1.4 \leq [Ni] + [Sn] \leq 2.4$, and $1.7 \leq [Ni]/[Sn] \leq 4.5$. The Ni content [Ni] in terms of % by mass, and a P content [P] in terms of % by mass satisfy a relationship of $22 \leq [Ni]/[P] \leq 220$. The copper alloy has a metallographic structure of an α single phase.

According to a third aspect of the invention, there is provided a copper alloy containing 18% by mass to 30% by mass of Zn, 1% by mass to 1.5% by mass of Ni, 0.2% by mass to 1% by mass of Sn, 0.003% by mass to 0.06% by mass of P, and a total amount of 0.0005% by mass to 0.2% by mass of at least one or more kinds of elements selected from the groups consisting of Al, Fe, Co, Mg, Mn, Ti, Zr, Cr, Si, Sb, As, Pb, and rare-earth elements, each element being contained in an amount of 0.0005% by mass to 0.05% by mass, and the remainder including Cu and unavoidable impurities. A Zn content [Zn] in terms of % by mass, a Sn content [Sn] in terms of % by mass, and a Ni content [Ni] in terms of % by mass satisfy relationships of $17 \leq f1 = [Zn] + 5 \times [Sn] - 2 \times [Ni] \leq 30$, $14 \leq f2 = [Zn] - 0.5 \times [Sn] - 3 \times [Ni] \leq 26$, and $8 \leq f3 = \{f1 \times (32 - f1)\}^{1/2} \times [Ni] \leq 23$. The Sn content [Sn] in terms of % by mass, and the Ni content [Ni] in terms of % by mass satisfy relationships of $1.3 \leq [Ni] + [Sn] \leq 2.4$, and $1.5 \leq [Ni]/[Sn] \leq 5.5$. The Ni content [Ni] in terms of % by mass, and a P content [P] in terms of % by mass satisfy a relationship of $20 \leq [Ni]/[P] \leq 400$. The copper alloy has a metallographic structure of an α single phase.

In the copper alloy of a fourth aspect of the invention according to the first to third aspects, conductivity may be 18% IACS to 27% IACS, an average gain size may be 2 μm to 12 μm, and circular or elliptical precipitates may exist, and an average particle size of the precipitates may be 3 nm to 180 nm, or a proportion of the number of precipitates having a particle size of 3 nm to 180 nm among the precipitates may be 70% or greater.

In the copper alloy of a fifth aspect of the invention according to the first to fourth aspects, the copper alloy may be used in parts of electronic and electrical apparatuses such as a connector, a terminal, a relay, and a switch.

According to a sixth aspect of the invention, there is provided a copper alloy sheet that is formed from the copper alloy according to the first to fifth aspects. The copper alloy sheet is manufactured by a manufacturing process including a casting process of casting the copper alloy, a hot-rolling process of hot-rolling the copper alloy, a cold-rolling process of cold-rolling the resultant rolled material obtained in the hot-rolling process at a cold reduction of 40% or greater, and a recrystallization heat treatment process of recrystallizing the resultant rolled material obtained in the cold-rolling process by using a continuous heat treatment furnace in accordance with a continuous annealing method under conditions in which a highest arrival temperature of the rolled material is 560° C. to 790° C., and a retention time in a high-temperature region from the highest arrival temperature-50° C. to the highest arrival temperature is 0.04 minutes to 1.0 minute. However, a pair of a cold-rolling process and an annealing process including batch type annealing may be carried out once or a plurality of times between the hot-rolling process and the cold-rolling process in accordance with the sheet thickness of the copper alloy sheet.

In the copper alloy sheet of a seventh aspect of the invention according to the sixth aspect, the manufacturing process may further include a finish cold-rolling process of finish cold-rolling the resultant rolled material that is obtained in the recrystallization heat treatment process, and a recovery heat treatment process of subjecting the resultant rolled material that is obtained in the finish cold-rolling process to a recovery heat treatment. In the recovery heat treatment process, the recovery heat treatment may be carried out by using a continuous heat treatment furnace under conditions in which a highest arrival temperature of the rolled material is 150° C. to 580° C., and a retention time in a high-temperature region from the highest arrival temperature-50° C. to the highest arrival temperature is 0.02 minutes to 100 minutes.

According to an eighth aspect of the invention, there is provided a method of manufacturing a copper alloy sheet formed from the copper alloy according to any one of the first to fifth aspects. The method includes a casting process, a pair of cold-rolling process and annealing process, a cold-rolling process, a recrystallization heat treatment process, a finish cold-rolling process, and a recovery heat treatment process. A process of subjecting the copper alloy or the rolled material to hot-working is not included. One or both of a combination of the cold-rolling process and the recrystallization heat treatment process, and a combination of the finish cold-rolling process and the recovery heat treatment process are carried out. The recrystallization heat treatment process is carried out by using a continuous heat treatment furnace under conditions in which a highest arrival temperature of the rolled material is 560° C. to 790° C., and a retention time in a high-temperature region from the highest arrival temperature-50° C. to the highest arrival temperature is 0.04 minutes to 1.0 minute. In the recovery heat treatment process, the copper alloy material obtained after the finish cold-rolling is subjected to a recovery heat treatment by using a continuous heat treatment furnace under conditions in which a highest arrival temperature of the rolled material is 150° C. to 580° C., and a retention time in a high-temperature region from the highest arrival temperature-50° C. to the highest arrival temperature is 0.02 minutes to 100 minutes.

Advantage of the Invention

According to the invention, it is possible to provide a copper alloy which is excellent in the cost performance, which has a small density, conductivity greater than that of phosphorus bronze or nickel silver, and high strength, which is excellent in a balance between strength, elongation, bending workability, and conductivity, stress relaxation characteristics, stress corrosion cracking resistance, discoloration resistance, and antimicrobial properties, and which is capable of coping with various use environments, and a copper alloy sheet that is formed from the copper alloy.

BEST MODE FOR CARRYING OUT THE INVENTION

Hereinafter, a copper alloy and a copper alloy sheet according to embodiments of the invention will be described. In this specification, an element symbol in parentheses such as [Zn] represents the content (% by mass) of a corresponding element. Further, with regard to contents of effectively added elements such as Co and Fe, and contents of respective unavoidable impurities, there is little effect on characteristics of the copper alloy sheet, and thus the contents are not included in a calculation expression. In addition, for example, less than 0.005% by mass of Cr is regarded as an unavoidable impurity.

In addition, in the embodiments, a plurality of composition relational expressions are defined as described below by using the expression method of the contents.

Composition relational expression $f1=[Zn]+5\times[Sn]-2\times[Ni]$

Composition relational expression $f2=[Zn]-0.5\times[Sn]-3\times[Ni]$

Composition relational expression $f3=\{f1\times(32-f1)\}^{1/2}\times[Ni]$

Composition relational expression $f4=[Ni]+[Sn]$

Composition relational expression $f5=[Ni]/[Sn]$

Composition relational expression $f6=[Ni]/[P]$

A copper alloy according to a first embodiment of the invention contains 18% by mass to 30% by mass of Zn, 1% by mass to 1.5% by mass of Ni, 0.2% by mass to 1% by mass of Sn, and 0.003% by mass to 0.06% by mass of P, the remainder including Cu and unavoidable impurities. The composition relational expression f1 satisfies a relationship of $17\leq f1\leq 30$, the composition relational expression f2 satisfies a relationship of $14\leq f2\leq 26$, the composition relational expression f3 satisfies a relationship of $8\leq f3\leq 23$, the composition relational expression f4 satisfies a relationship of $1.3\leq f4\leq 2.4$, the composition relational expression f5 satisfies a relationship of $1.5\leq f5\leq 5.5$, and the composition relational expression f6 satisfies a relationship of $20\leq f6\leq 400$.

A copper alloy according to a second embodiment of the invention contains 19% by mass to 29% by mass of Zn, 1% by mass to 1.5% by mass of Ni, 0.3% by mass to 1% by mass of Sn, and 0.005% by mass to 0.06% by mass of P, the remainder including Cu and unavoidable impurities. The composition relational expression f1 satisfies a relationship of $18\leq f1\leq 30$, the composition relational expression f2 satisfies a relationship of $15\leq f2\leq 25.5$, the composition relational expression f3 satisfies a relationship of $9\leq f3\leq 22$, the composition relational expression f4 satisfies a relationship of $1.4\leq f4\leq 2.4$, the composition relational expression f5 satisfies a relationship of $1.7\leq f5\leq 4.5$, and the composition relational expression f6 satisfies a relationship of $22\leq f6\leq 220$.

A copper alloy according to a third embodiment of the invention contains 18% by mass to 30% by mass of Zn, 1% by mass to 1.5% by mass of Ni, 0.2% by mass to 1% by mass of Sn, 0.003% by mass to 0.06% by mass of P, and a total amount of 0.0005% by mass to 0.2% by mass of at least one or more kinds of elements selected from the groups consisting of Al, Fe, Co, Mg, Mn, Ti, Zr, Cr, Si, Sb, As, Pb, and rare-earth elements, each element being contained in an amount of 0.0005% by mass to 0.05% by mass, and the remainder including Cu and unavoidable impurities. The composition relational expression f1 satisfies a relationship of $17\leq f1\leq 30$, the composition relational expression f2 satisfies a relationship of $14\leq f2\leq 26$, the composition relational expression f3 satisfies a relationship of $8\leq f3\leq 23$, the composition relational expression f4 satisfies a relationship of $1.3\leq f4\leq 2.4$, the composition relational expression f5 satisfies a relationship of $1.5\leq f5\leq 5.5$, and the composition relational expression f6 satisfies a relationship of $20\leq f6\leq 400$.

In addition, the copper alloys according to the first to third embodiments of the invention have a metallographic structure of an α single phase.

In addition, in the copper alloys according to the first to third embodiments of the invention, it is preferable that an average gain size is 2 μm to 12 μm, circular or elliptical precipitates exist, and an average particle size of the precipitates is 3 nm to 180 nm, or a proportion of the number of precipitates having a particle size of 3 nm to 180 nm among the precipitates is 70% or greater.

In addition, in the copper alloys according to the first to third embodiments of the invention, conductivity is preferably set to 18% IACS to 27% IACS.

In addition, in the copper alloys according to the first to third embodiments of the invention, it is preferable that strength and stress relaxation characteristics are defined as described later.

Hereinafter, description will be given of the reason why the component composition, the composition relational expressions f1, f2, f3, f4, f5, and f6, the metallographic structure, and the characteristics are defined as described above.

Zn

Zn is a principal element of the alloy, and at least 18% by mass or greater is necessary to overcome the problems of the invention. In order to lower the cost, a density of the alloy of the invention is made to be smaller than that of pure copper by approximately 3% or greater, and the density of the alloy of the invention is made to be smaller than that of phosphorus bronze or nickel silver by approximately 2% or greater. In addition, in order to improve strength such as tensile strength, a proof stress, a yield stress, a spring property, and fatigue strength, and discoloration resistance, and in order to obtain a fine grain, it is necessary for the Zn content to be 18% by mass or greater. In order to attain a more effective result, the lower limit of the Zn content is preferably set to 19% by mass or greater or 20% by mass or greater, and more preferably 23% by mass or greater.

On the other hand, if the Zn content is greater than 30% by mass, even when Ni, Sn, and the like are contained in the present composition range to be described later, it is difficult to obtain satisfactory stress relaxation characteristics and stress corrosion cracking properties, conductivity deteriorates, ductility and bending workability also deteriorate, and an improvement of the strength is saturated. The upper limit of the Zn content is more preferably 29% by mass or less, and still more preferably 28.5% by mass or less.

However, among copper alloys which contain 19% by mass or greater or 23% by mass or greater in the related art, it is difficult to find a copper alloy which is excellent in the stress relaxation characteristics and the discoloration resistance, and has the strength, the corrosion resistance, and the conductivity which are satisfactory.

Ni

Ni is contained so as to improve the discoloration resistance, the stress corrosion cracking resistance, the stress relaxation characteristics, heat resistance, ductility, bending workability, and a balance between the strength, the ductility, and the bending workability. Particularly, when Zn content is set to a concentration as high as 19% by mass or greater or 23% by mass or greater, the above-described characteristics operate in a more effective manner. In order to exhibit the effect, it is necessary for Ni to be contained in an amount of 1% by mass or greater, and preferably 1.1% by mass or greater.

Further, it is necessary to satisfy at least a relationship of a composition ratio between Sn and P, and six composition relational expressions (f1, f2, f3, f4, f5, and f6). Particularly, Ni is necessary to utilize the advantage of Sn to be described later, and to further utilize the advantage of Sn in comparison to a case where Sn is contained alone, and to overcome a problem of Sn on a metallographic structure. On the other hand, in a case where Ni is contained in an amount greater than 1.5% by mass, this case leads to an increase in the cost, and conductivity is lowered, and thus the Ni content is set to 1.5% by mass or less.

Sn

Sn is contained to improve the strength of the alloy of the invention, and to improve the discoloration resistance, the stress corrosion cracking resistance, the stress relaxation characteristics, and the balance between the strength, the ductility, and the bending workability, and to make a grain fine during recrystallization due to co-addition of Ni and P. To exhibit the effects, it is necessary for Sn to be contained in an amount of 0.2% by mass or greater, it is necessary for Ni and P to be contained, and it is necessary to satisfy the six relational expressions (f1, f2, f3, f4, f5, and f6). According to this, it is possible to utilize the characteristics of Sn to the maximum. In order to make the effects more significant, the lower limit of the Sn content is preferably set to 0.25% by mass or greater, and more preferably 0.3% by mass or greater. On the other hand, even though Sn is contained in an amount of 1% by mass or greater, the effect of the stress corrosion cracking resistance and the stress relaxation characteristics deteriorates rather than being saturated, and the ductility and the bending workability deteriorate. Particularly, when the concentration of Zn is as high as 25% by mass or greater, a β-phase or a γ-phase tends to remain during implementation. Preferably, the upper limit of the Sn content is 0.9% by mass or less.

P

P has an effect of improving the stress relaxation characteristics, lowering stress corrosion cracking susceptibility, and improving the discoloration resistance, and is capable of making a grain fine in combination with Ni. To attain the effects, it is necessary for the P content to be at least 0.003% by mass or greater. When considering that an appropriate amount of P in a solid-solution state, and an appropriate amount of precipitates of Ni and P are necessary to improve the stress relaxation characteristics, to lower the stress corrosion cracking susceptibility, and to improve the discoloration resistance, the lower limit of the P content is preferably 0.005% by mass or greater, more preferably 0.008% by mass or greater, and still more preferably 0.01% by mass or greater. On the other hand, even when the lower limit is greater than 0.06% by mass, the above-described effects are saturated, precipitates including P and Ni as a main component increase, and a particle size of the precipitate increases. As a result, the bending workability deteriorates. The upper limit of the P content is preferably 0.05% by mass or less. However, the following ratio (composition relational expression f6) of Ni and P is important to improve the stress relaxation characteristics and to lower the stress corrosion cracking susceptibility, and a balance between Ni and P in a solid-solution state, and the precipitates of Ni and P is also important.

At Least One Kind or Two Kinds Selected from Al, Fe, Co, Mg, Mn, Ti, Zr, Cr, Si, Sb, As, Pb, and Rare-Earth Elements Elements such as Al, Fe, Co, Mg, Mn, Ti, Zr, Cr, Si, Sb, As, Pb, and rare-earth elements have an operational effect of improving various characteristics. Accordingly, in the copper alloy of the third embodiment, these elements are contained.

Here, Fe, Co, Al, Mg, Mn, Ti, Zr, Cr, Si, Sb, As, Pb, and rare-earth elements make a grain of an alloy fine. Fe, Co, Al, Mg, Mn, Ti, and Zr form a compound with P or Ni, and suppress growth of a crystallized grain during annealing, and thus have a great effect on refinement of a grain. Particularly, the above-described effect is greater with Fe and Co, and Fe and Co form a compound of Ni and P which contains Fe and Co, and make a particle size of the compound fine. The fine compound makes the size of the recrystallized grain finer during annealing, and improves the strength. However, if the effect is excessive, the bending workability and the stress relaxation characteristics are damaged. In addition, Al, Sb, and As have an effect of improving the discoloration resistance of an alloy, and Pb has an effect of improving press moldability.

In order to exhibit the effects, it is necessary for any element among Fe, Co, Al, Mg, Mn, Ti, Zr, Cr, Si, Sb, and As to be contained in an amount of 0.0005% by mass or greater. On the other hand, when the amount of any element is greater than 0.05% by mass, the bending workability deteriorates rather than saturation of the effects. Preferably, the upper limit of the amount of these elements is 0.03% by mass or less in any element. In addition, when a total amount of these elements is greater than 0.2% by mass, the bending workability deteriorates rather than saturation of the effect. The upper limit of the total amount of the elements is preferably 0.15% by mass or less, and more preferably 0.1% by mass or less.

Unavoidable Impurities

A raw material including a returned material and a slight amount of elements such as oxygen, hydrogen, carbon, sulfur, and water vapor are unavoidably contained in the copper alloy during a manufacturing process mainly including melting in the air, and thus the copper alloy contains these unavoidable impurities.

Here, in the copper alloys of the embodiments, element other than defined component elements may be regarded as the unavoidable impurities, and an amount of the unavoidable impurities is preferably set to 0.1% by mass or less.

Composition Relational Expression f1 When a value of the composition relational expression $f1=[Zn]+5\times[Sn]-2\times[Ni]$ is 30, this value is a boundary value indicating whether or not the metallographic structure of the alloy of the invention is substantially constituted by only an α-phase, and the value is also a boundary value capable of obtaining the stress relaxation characteristics, the ductility, and the bending workability which are satisfactory. It is necessary for the amount of Zn that is contained as a principal element to be 30% by mass or less, and it is necessary to satisfy the above-described relational expression. When Sn that is a low-melting metal is contained in a Cu—Zn alloy in an amount of 0.2% by mass, or 0.3% by mass or greater, segregation of Sn occurs at a final solidification portion and a grain boundary during casting. As a result, a γ-phase and a β-phase in which a concentration of Sn is high are formed. When the value is greater than 30, it is difficult to make the γ-phase and the β-phase which exist in a non-equilibrium state disappear even when undergoing casting, hot-working, an annealing and heat treatment, or brazing of product working, or even when considering heat treatment conditions and the like. With regard to the composition relational expression f1, in a composition range of the invention, a coefficient of "+5" is given to Sn. The coefficient "5" is greater than a coefficient of "1" of Zn that is a principal element. On the other hand, in the composition range of the invention, Ni has a property of reducing segregation of SN and blocking formation of the γ-phase and the β-phase, and a coefficient of "−2" is given to Ni. When the value of the composition relational expression $f1=[Zn]+5\times[Sn]-2\times[Ni]$ is 30 or less, the alloy of the invention includes a grain boundary, and the γ-phase and the β-phase do not completely disappear even when considering a product working method. When the γ-phase and the β-phase completely disappear in the metallographic structure, the ductility and the bending workability of the alloy of the invention become satisfactory, and the stress relaxation characteristics become satisfactory. The value of f1=[Zn]+5×[Sn]−2×[Ni] is more preferably 29.5 or less, and still more preferably 29 or less. On the other hand, when the value of f1=[Zn]+5×[Sn]−2×[Ni] is less than 17, the strength is low, and the discoloration resistance also deteriorates, and thus the value is preferably 18 or greater, more preferably 20 or greater, and still more preferably 23 or greater.

Composition Relational Expression f2

When a value of the composition relational expression f2=[Zn]−0.5×[Sn]−3×[Ni] is 26, this value is a boundary value at which the alloy of the invention can obtain the stress corrosion cracking resistance, the ductility, and the bending workability which are satisfactory. As described above, examples of the fatal defect of the Cu—Zn alloy include high susceptibility to the stress corrosion cracking. In the case of the Cu—Zn alloy, the susceptibility of the stress corrosion cracking depends on the Zn content, and when the Zn content is greater than 25% by mass or 26% by mass, particularly, the susceptibility to the stress corrosion cracking increases. A composition relational expression f2=26 corresponds to the Zn content of 25% by mass or 26% by mass. In a composition range of the invention in which Ni and Sn are co-added, particularly, it is possible to lower the stress corrosion cracking susceptibility due to Ni that is contained. The upper limit of the composition relational expression f2 is preferably 25.5 or less. On the other hand, when the value of f2=[Zn]−0.5×[Sn]−3×[Ni] is less than 14, the strength is low, and the discoloration resistance also deteriorates, and thus the value is preferably 15 or greater, and more preferably 18 or greater.

Composition Relational Expression f3

With regard to the composition relational expression $f3=\{f1\times(32-f1)\}^{1/2}\times[Ni]$, when Ni and Sn are co-added, f1 is 30 or less, and a value of $f3=\{f1\times(32-f1)\}^{1/2}\times[Ni]$ is 8 or greater, excellent stress relaxation characteristics are exhibited even when containing Zn in a high concentration. The lower limit of the composition relational expression f3 is preferably 9 or greater, and more preferably 10 or greater. On the other hand, even when the value of $f3=\{f1\times(32-f1)\}^{1/2}\times[Ni]$ is greater than 23, the effect thereof is saturated. The upper limit of the composition relational expression f3 is preferably 22 or less.

Composition Relational Expression f4

In order to improve the discoloration resistance of the alloy in the composition range of the invention, it is necessary for the composition relational expression f4=[Ni]+[Sn], which indicates a total amount of Ni and Sn, to be 1.3 or greater, and preferably 1.4 or greater. In order to improve the stress relaxation characteristics, and in order to obtain higher strength, it is preferable that the value of the composition relational expression f4=[Ni]+[Sn] is 1.3 or greater. On the other hand, when the value of the composition relational expression f4=[Ni]+[Sn] is greater than 2.4, the cost of the alloy increases, and conductivity deteriorates, and thus 2.4 or less is preferable.

Composition Relational Expression f5

In the stress relaxation characteristics of the Cu—Zn alloy in which Ni, Sn, and P are co-added in the composition range of the invention, and which contains Zn at a high concentration, the composition relational expression f5=[Ni]/[Sn] is also important. In order to potentially improve the stress relaxation characteristics to have an operation of raising the strength, and in order to overcome the problem on the metallographic structure to utilize Sn with a high atomic valence to the maximum, an existence ratio with divalent Ni, that is, a balance, is important. With respect to one tetravalent Sn atom that exists in a matrix, when at least three or more divalent Ni atoms exist, the present inventors have found that if a value of [Ni]/[Sn] is 1.5 or greater in terms of a mass ratio, the stress relaxation characteristics are further improved. Particularly, in the alloy of the invention that is subjected to a recovery treatment after finish rolling, the effect becomes more significant. The value of the composition relational expression f5=[Ni]/[Sn] is preferably 1.7 or greater, and more preferably 2.0 or greater. When the value of [Ni]/[Sn] is 1.5 or greater, 1.7 or greater, or 2.0 or greater, it is possible to suppress precipitation of the β-phase or the γ-phase in the metallographic structure in combination with other conditions such as a case where the Zn content is great, and a case where the value of f1 is great. When the value of composition relational expression f5=[Ni]/[Sn] is 4.5 or less, the stress relaxation characteristics are satisfactory, and when the value is greater than 5.5, the stress relaxation characteristics deteriorate.

Composition Relational Expression f6

In addition, the stress relaxation characteristics are affected by Ni and P which are in a solid-solution state, and the compound of Ni and P. Here, when a value of the composition relational expression f6=[Ni]/[P] is less than 20, a proportion of the compound of Ni and P is greater in comparison to Ni in a solid-solution state, and thus the stress relaxation characteristics deteriorate, and the bending workability also deteriorates. That is, when the value of the composition relational expression f6=[Ni]/[P] is 20 or greater, and preferably 22 or greater, the stress relaxation characteristics and the bending workability become satisfactory. On the other hand, when the value of the composition relational expression f6=[Ni]/[P] is greater than 400, an amount of the compound formed from Ni and P, and an amount of P that is solid-soluted decrease, and thus the stress relaxation characteristics deteriorate. The upper limit of the composition relational expression f6 is preferably 220 or less, more preferably 150 or less, and still more preferably 100 or less. In addition, when the value is greater than 400, an operation of making a grain fine also becomes small, and thus the strength of the alloy is lowered.

α Single Phase Structure

When the β-phase and the γ-phase exist, particularly, the ductility and the bending workability are damaged, and thus the stress relaxation characteristics, the stress corrosion cracking resistance, and the discoloration resistance deteriorate. However, in the embodiments, the α-phase structure is targeted to a structure having a size which has a significant effect on the above-described characteristics and with which the β-phase and the γ-phase are clearly recognized when observing the metallographic structure with a metallographic microscope at a magnification of 300 times. A substantial α single phase represents that when observing the metallographic structure with the metallographic microscope at a magnification of 300 times (visual field: 89 mm×127 mm), the percentage of the α-phase in the metallographic structure other than a non-metallic inclusion including an oxide, and an intermetallic compound such as a crystallized product and a precipitate is 100%.

Average Grain Size

In the copper alloys of the embodiments, particularly, when being used for a terminal, a connector, and the like, an average grain size is preferably set to 2 μm to 12 μm for the following reasons.

In the copper alloys of the embodiments, although different in accordance with a manufacturing process, a grain of minimum 1 μm can be obtained, and when the average grain size is less than 2 μm, the stress relaxation characteristics deteriorate, and the strength increases. However, there is a concern that the ductility and the bending workability may deteriorate. Particularly, when considering the stress relaxation characteristics, it is preferable that a grain size distribution is slightly larger, more preferably 3 μm or greater, and still more preferably 4 μm or greater. On the other hand, in a use for a terminal, a connector, and the like, when the average grain size is greater than 12 μm, there is a concern that it is difficult to obtain high strength, and the susceptibility to the stress corrosion cracking increases. The stress relaxation characteristics are also saturated at approximately 7 μm to 9 μm, and thus the upper limit of the average grain size is preferably 9 μm or less, and more preferably 8 μm or less.

Precipitate

In the copper alloys of the embodiments, it is preferable to define the size or the number of precipitates for the following reasons.

When circular or elliptical precipitates which mainly include Ni and P exist, growth of a recrystallized grain is suppressed, and thus a fine grain is obtained, and the stress relaxation characteristics are improved. Recrystallization, which occurs during annealing, is an operation of changing a crystal that is significantly deformed due to working to a new crystal that almost has no deformation. However, in the recrystallization, a grain that is subjected to working is not instantly changed to a recrystallized grain, and a long time, or a relatively higher temperature is necessary. That is, time and a temperature are necessary from initiation of occurrence of the recrystallization to termination of the recrystallization. A recrystallized grain that is generated first grows and becomes large before the recrystallization is completely terminated, but it is possible to suppress the growth by the precipitates.

When an average particle size of the precipitates is less than 3 nm, or the percentage of the precipitate is less than 70%, an operation of improving the strength and an operation of suppressing the grain growth are provided, but an amount of the precipitates increases, and thus the bending workability is impeded. On the other hand, when the average particle size of the precipitates is greater than 180 nm, or the percentage of the precipitate is greater than 70%, the number of the precipitate decreases, and thus the operation of suppressing the growth of a grain is damaged, and the effect relating to the stress relaxation characteristics decreases. Accordingly, in the embodiments, the average particle size of the precipitates is set to 3 nm to 180 nm, or the percentage of the number of precipitates having a particle size of 3 nm to 180 nm among the precipitates is set to 70% to 100%. Further, in this embodiment, specific treatments such as a solution treatment in which cooling is carried out from a high temperature at a fast speed, and aging for a precipitation treatment for a long time at a temperature equal to or lower than a recrystallization temperature are not carried out, and thus fine precipitates which greatly contribute to the strength are not obtained. The average particle size is preferably 5 nm or greater, and more preferably 7 nm or greater. Further, the average particle size is 150 nm or less, and more preferably 100 nm or less. In addition, it is more preferable that the percentage of the number of precipitates having a particle size of 3 nm to 180 nm among the precipitates is 80% to 100%.

Conductivity

In members which are targets of the invention, it is not particularly necessary for the upper limit of the conductivity to be greater than 27% IACS or greater than 26% IACS, and a configuration excellent in the stress relaxation characteristics, the stress corrosion cracking resistance, the discoloration resistance, and the strength, which are defects in the brass of the related art, is most useful in the invention. In addition, spot welding may be carried out in accordance with the use, and when the conductivity is too high, a problem may also occur. On the other hand, a conductive use such as a connector and a terminal, in which conductivity is greater than that of expensive phosphorous bronze or nickel silver, is targeted, and thus it is preferable that the lower limit of the conductivity is 18% IACS or greater or 19% IACS or greater.

Hardness

In the copper alloys of the embodiments, there is no particular definition with respect to the strength. However, in a case where the copper alloy is used for a terminal, a connector, and the like, on the assumption that the ductility and the bending workability are satisfactory, in a sample in which a test specimen is collected in directions of 00 and 900 with respect to a rolling direction, with regard to strength at room temperature, tensile strength is at least 500 $N/mm^2$ or greater, preferably 550 $N/mm^2$ or greater, more preferably 575 $N/mm^2$ or greater, and still more preferably 600 $N/mm^2$ or greater. Further, a proof stress is at least 450 $N/mm^2$ or greater, preferably 500 $N/mm^2$ or greater, more preferably 525 N/mm or greater, and still more preferably 550 $N/mm^2$ or greater. Further, with regard to a preferable upper limit of the strength at room temperature, the tensile strength is 800 $N/mm^2$ or less, and the proof stress is 750 $N/mm^2$ or less.

In addition, in a case of a use for a terminal, a connector, and the like, it is preferable that both of the tensile strength indicating fracture strength, and the proof stress indicating initial deformation strength are high. In addition, it is preferable that a ratio of the proof stress/the tensile strength is large. In addition, it is preferable that a difference between strength in a direction parallel to a rolling direction of a sheet and strength in a direction perpendicular to the rolling direction is small. Here, when setting tensile strength and a proof stress as $TS_P$ and $YS_P$, respectively, in a case of collecting a test specimen in a direction parallel to the rolling direction, and when setting the tensile strength and the proof stress as $TS_O$ and $YS_O$, respectively, in a case of collecting a test specimen in a direction perpendicular to the rolling direction, relationships thereof can be expressed with mathematical expressions as follows.

(1) Proof stress/tensile strength (parallel to the rolling direction, perpendicular to the rolling direction) is 0.9 to 1, and preferably 0.92 to 1.0.

$$0.9 \leq YS_P/TS_P \leq 1.0$$

$$0.9 \leq YS_O/TS_O \leq 1.0$$

(2) The tensile strength in the case of collecting the test specimen in a direction parallel to the rolling direction/the tensile strength in the case of collecting the test specimen in a direction perpendicular to the rolling direction is 0.9 to 1.1, and preferably 0.92 to 1.05.

$$0.9 \leq TS_P/TS_O \leq 1.1$$

(3) The proof stress in the case of collecting the test specimen in a direction parallel to the rolling direction/the proof stress in the case of collecting the test specimen in a direction perpendicular to the rolling direction is 0.9 to 1.1, and preferably 0.92 to 1.05.

$$0.9 \leq YS_P/YS_O \leq 1.1$$

To accomplish the above-described relationships, a final cold reduction, an average gain size, and a process are important. When the final cold reduction is less than 5%, it is difficult to obtain high strength, and a ratio of proof stress/tensile strength is small. The lower limit of the cold reduction is preferably 10% or greater. On the other hand, at a reduction that is greater than 50%, the bending workability and the ductility deteriorate. The upper limit of the cold reduction is preferably 35% or less. However, it is possible to make the ratio of proof stress/tensile strength large, that is, close to 1.0 through the following recovery heat treatment, thereby making a difference in the proof stress between the parallel direction and the perpendicular direction small.

Stress Relaxation Characteristics

The copper alloy is used as a terminal, a connector, and a relay in an environment of approximately 100° C. or higher, for example, at the inside of automobiles under the blazing sun or at a portion close to an engine room. As a principal function that is demanded for the terminal and the connector, a high contact pressure may be exemplified. At room temperature, the maximum contact pressure corresponds to a stress of an elastic limit, or 80% of a proof stress when carrying out tensile test of a material, but when being used for a long time in an environment of 100° C. or higher, the material is permanently deformed, and thus the stress of the elastic limit, or a stress corresponding to 80% of the proof stress cannot be used as the contact pressure. A stress relaxation test is a test for examining to what extent a stress is relaxed after retention for 1,000 hours at 120° C. or 150° C. in a state in which a stress corresponding to 80% of the proof stress is applied to the material. That is, in a case of being used in an environment of approximately 100° C. or higher, an effective maximum contact pressure is expressed by proof stress×80%×(100%-stress relaxation rate (%)). In addition to a simply high proof stress at room temperature, it is preferable that a value of the expression is high. In a test at 150° C., in a case where a value of proof stress×80%×(100%-stress relaxation rate (%)) is 240 N/mm$^2$ or greater, use in a high-temperature state is possible although a slight problem is present. In a case where the value is 270 N/mm$^2$ or greater, this case is suitable for use in a high-temperature state, and 300 N/mm$^2$ or greater is optimal for the use. For example, in a case of 70% Cu-30% Zn which is a representative alloy of brass and has a proof stress of 500 N/mm$^2$, at 150° C., the value of proof stress×80%×(100%-stress relaxation rate (%)) is approximately 70 N/mm$^2$. Similarly, in a case of phosphorus bronze having a composition of 94% Cu-6% Sn and has a proof stress of 550 N/mm$^2$, the value is approximately 180 N/mm$^2$, and thus it can be said that the value is not satisfactory in a current alloy in practical use.

In a case where material target strength is set as described above, it can be said that the material target strength is a very high level when considering that in a test under severe conditions of 150° C. and 1,000 hours, if the stress relaxation rate is 30% or less, particularly, 25% or less, the brass has a high Zn concentration. In addition, when the stress relaxation rate is greater than 30% and equal to or less than 40%, it can be said that this stress relaxation rate is satisfactory. In addition, when the stress relaxation rate is greater than 40% and equal to or less than 50%, it can be said that there is a problem for use. In addition, when the stress relaxation rate is greater than 50%, it can be said that use in a severe thermal environment is substantially difficult. On the other hand, in a test under slight mild conditions of 120° C. and 1,000 hours, relatively higher performance is demanded. When the stress relaxation rate is 14% or less, it can be said that this stress relaxation rate is a high level. When the stress relaxation rate is greater than 14% and equal to or less than 21%, it can be said that the stress relaxation rate is satisfactory. When the stress relaxation rate is greater than 21% and equal to or less than 40%, it can be said that there is a problem for use. When the stress relaxation rate is greater than 40%, it can be said that use in a mild thermal environment is substantially difficult.

Next, description will be given of a method of manufacturing the copper alloys according to the first to third embodiment of the invention, and copper alloy sheets formed from the copper alloys according to the first to third embodiments.

First, an ingot having the above-described component composition is prepared, and this ingot is subjected to hot working. Representatively, the hot working is hot-rolling. A hot-rolling initiation temperature is set to 760° C. to 890° C. to allow each element to enter a solid-solution state and to additionally reduce segregation of Sn, from the viewpoint of hot-ductility. It is preferable that a hot-rolling reduction is set to at least 50% or greater to reduce fracture of a coarse casting structure in the ingot, or segregation of an element such as Sn. In addition, in order to allow P and Ni to enter a further solid-solution state, it is preferable that cooling is carried out at an average cooling rate of 1° C./second in a temperature region from a temperature at the time of completing final rolling or 650° C. to 350° C. to prevent a compound of Ni and P, which is a precipitate, from being coarsened.

In addition, after reducing the thickness through cold-rolling, a crystallization heat treatment, that is, an annealing process progresses. Although different in accordance with a final product thickness, a cold-rolling reduction is set to at least 40% or greater, and preferably 55% to 97%. In order to fracture a hot-rolling structure, the lower limit of the cold-rolling reduction is set to 40%, and preferably 55% or greater. The cold-rolling is terminated before material deformation deteriorates due to strong working at room temperature. Although different in accordance with a final target grain size, it is preferable that a grain size is set to 3 μm to 30 μm in the annealing process. With regard to specific temperature conditions, in a case of a batch type, the annealing process is carried out under conditions of retention for 1 hour to 10 hours at 400° C. to 650° C. In addition, an annealing method such as continuous annealing, which is carried out in a short time at a high temperature, is widely used. During the annealing, a highest arrival temperature of a material is 560° C. to 7900° C., and in a high-temperature state of "the highest arrival temperature-50° C.", a high-temperature region from the highest arrival temperature-50° C. to the highest arrival temperature is retained for 0.04 minutes to 1.0 minute. The continuous annealing method is also used in the following recovery heat treatment. However, the annealing process and the cold-rolling process may be omitted in accordance with a final product thickness, or may be carried out a plurality of times. When the metallographic structure is in a mixed grain state in which a large grain and a small grain are mixed in, the stress relaxation characteristics, the bending workability, and the stress corrosion cracking resistance deteriorate, and anisotropy in mechanical properties occurs between a direction parallel to the rolling direction and a direction perpendicular to the rolling direction. In the invention, precipitates, which contain Ni and P as a main component, maintain a recrystallized grain in a fine state during annealing due to an operation of suppressing grain growth. However, when heating is carried out at a high temperature for a long time, that is, high-temperature annealing is carried out in a batch type, the precipitates including Ni and P as a main component start to be solid-soluted, and thus a pinning effect that is an growth suppressing operation disappears at a predetermined portion, and thus there is a concern that a phenomenon in which a grain abnormally grows may occur. That is, when the pinning effect locally disappears due to the precipitates of Ni and P, a phenomenon, in which a recrystallized grain that abnormally grows and a recrystallized grain that is retained in a fine state are mixed in, occurs. In the alloy of the invention, when the batch type annealing is carried out to obtain a recrystallized grain of 5 μm or greater, or 10 μm or greater, the above-described phenomenon tends to occur. However, in a case of annealing that is carried out at a high temperature for a short time, that is, continuous annealing, the precipitates disappear in an approximately uniform manner, and thus even when an average grain size is greater than 5 μm, or 10 μm, the mixed grain state is less likely to occur.

Next, cold-rolling before finish is carried out. Although different in accordance with a final product thickness, it is preferable that a cold-rolling reduction is 40% to 96%. In addition, in final annealing that is the subsequent final recrystallization heat treatment, a reduction of 40% or greater is necessary for obtaining a more fine and uniform grain, and the reduction is set to 96% or less, and preferably 90% or less in consideration of material deformation.

Further, in order to make a final target size of a grain fine and uniform, it is preferable to define a relationship between a grain size after an annealing process that is a heat treatment immediately before final annealing, and a cold-rolling reduction before finish. That is, when a grain size after the final annealing is set as D1, a grain size after the annealing process immediately before the final annealing is set as D0, and a cold reduction in cold-rolling before finish is set as RE (%), it is preferable that $D0 \leq D1 \times 6 \times (RE/100)$ is satisfied at RE of 40 to 96. In order to make a recrystallized grain after the final annealing fine and uniform, it is preferable that a grain size after the annealing process is set to be equal to or less than the product of 6 times a grain size after the final annealing, and RE/100. As a cold reduction is higher, a nucleus generation site of a recrystallization nucleus further increases, and thus even when the grain size after the annealing process has a size three or more times the grain size after the final annealing, a fine and uniform recrystallized grain is obtained.

In addition, the final annealing is a heat treatment for obtaining a target grain size. In a case of a use for a terminal, a connector, and the like, a target average grain size is 2 μm to 12 μm, and when emphasizing the strength, the grain is made to be small, and when emphasizing the stress relaxation characteristics, the grain is made to be slightly larger in the above-described range. Although different in accordance with a rolling reduction before finish, the thickness of a material, and the target grain size, with regard to annealing conditions, in a case of the batch type, retention is carried out at 350° C. to 550° C. for 1 hour to 10 hours, and in a case of high-temperature and short-time annealing, the highest arrival temperature is 560° C. to 790° C., and retention is carried out at a temperature of the highest arrival temperature-50° C. for 0.04 minutes to 1.0 minute. Further, in a case of emphasizing the stress relaxation characteristics as described above, the average grain size is preferably 3 μm to 12 μm, or 5 μm to 9 μm, and thus high-temperature and short-time continuous annealing is preferable so as to avoid mixing-in. Similarly, the high-temperature and short-time continuous annealing is preferable even when securing coarsening of precipitates or an amount of solid-solution of P in a matrix.

A recrystallization heat treatment of the rolling before finish, that is, the final annealing, is preferably a high-temperature and short-time continuous heat treatment, or continuous annealing. Specifically, the final annealing includes a heating step of heating a copper alloy material at a predetermined temperature, a retention step of retaining the copper alloy material at a predetermined temperature for a predetermined time after the heating step, and a cooling step of cooling the copper alloy material to a predetermined temperature after the retention step. When the highest arrival temperature of the copper alloy material is set as Tmax (° C.), and time taken for heating and retention in a temperature region from a temperature lower than the highest arrival temperature of the copper alloy material by 50° C. to the highest arrival temperature is set as tm (min), relationships of $560 \leq Tmax \leq 790$, $0.04 \leq tm \leq 1.0$, and $500 \leq It1 = (Tmax - 30 \times tm^{-1/2}) \leq 680$ are satisfied. In a case of carrying out annealing with the high-temperature and short-time continuous annealing, when the highest arrival temperature is higher than 790° C., or It1 is greater than 680, 1) a recrystallized grain becomes larger, and may be greater than 12 μm, 2) the majority of the precipitates including Ni and P as a main component is solid-soluted, and thus the precipitates too decrease, 3) a slight amount of precipitates are coarsened, and 4) a β-phase or a γ-phase precipitates during a heat treatment. According to this, the stress relaxation characteristics deteriorate, the stress corrosion cracking resistance deteriorates, the strength is lowered, and the bending workability deteriorates. In addition, there is a concern that anisotropy in mechanical properties such as tensile strength, a proof stress, and elongation may occur between a direction parallel to the rolling direction and a direction perpendicular to the rolling direction. The upper limit of Tmax is preferably 760° C. or lower, and the upper limit of It1 is preferably 670 or less. On the other hand, when Tmax is lower than 560° C. or It1 is less than 500, fine recrystallization occurs or a fine recrystallized grain as small as less than 2 μm is obtained even through the recrystallization, and thus the bending workability and the stress relaxation characteristics deteriorate. Preferably, the lower limit of Tmax is 580° C. or higher, and the lower limit of It1 is 520 or greater. Further, in the high-temperature and short-time continuous heat treatment method, the heating step and the cooling step may be different, and conditions may be slightly different in accordance with a structure of an apparatus. However, in the above-described ranges, there is no problem. Further, the object and the target of the invention can be accomplished even through batch-type annealing, but when heating is carried out for a long time and at a high temperature during the batch-type annealing, a particle size of precipitates tends to increase. In addition, in the batch-type annealing, a cooling rate is slow, and thus an amount of P that is solid-soluted decreases, and thus a balance between an amount of Ni in a solid-solution state and an amount of Ni and P which precipitate deteriorates. As a result, the stress relaxation characteristics slightly deteriorate. As described above, temperature conditions of "the highest arrival temperature" and "the temperature lower than the highest arrival temperature by 50° C." are higher than an annealing temperature in the batch-type annealing. According to this, even when the annealing before the final annealing is the batch-type annealing, if the final annealing is carried out by the high-temperature and short-time continuous heat treatment method, it is possible to almost cancel the amount of P that is solid-soluted during the previous batch-type annealing, the amount of Ni in a solid-solution state, and the amount of Ni and P which precipitate. That is, in a final copper alloy sheet, the amount of P that is solid-soluted, the amount of Ni in the solid-solution state, and the amount of Ni and P which precipitate mostly depend on the final annealing method. Accordingly, it is preferable that the final annealing method is executed by the high-temperature and short-time continuous heat treatment method also in consideration of the problem related to mixing-in of a grain.

After the final annealing, finish rolling is carried out. Although different in accordance with a grain size, target strength, and bending workability, a finish rolling reduction is preferably 5% to 50% because a target balance between the bending workability and the strength in the invention is satisfactory. When the finish rolling reduction is less than 5%, even when the grain size is as fine as 2 μm to 3 μm, it is difficult to obtain high strength, particularly, a high proof stress, and thus the rolling reduction is preferably 10% or greater. On the other hand, as the rolling reduction becomes higher, strength becomes higher due to work hardening, but the ductility and the bending workability deteriorate. Even in a case where the size of the grain is large, when the rolling reduction is greater than 50%, the ductility and the bending workability deteriorate. The rolling reduction is preferably 40% or less, and more preferably 35% or less.

After the final finish rolling, correction may be carried out by a tension leveler so as to improve a deformed state. When a recovery heat treatment is further carried out in some cases after tension leveling, the stress relaxation characteristics, the ductility, and the bending workability are improved. A recovery heat treatment process is preferably carried out by a high-temperature and short-time continuous heat treatment, and includes a heating step of heating a copper alloy material at a predetermined temperature, a retention step of retaining the copper alloy material at a predetermined temperature and for a predetermined time after the heating step, and a cooling step of cooling the copper alloy material to a predetermined temperature after the retention step. In addition, when the highest arrival temperature of the copper alloy material is set as Tmax2 (° C.), and time taken for heating and retention in a temperature region from a temperature lower than the highest arrival temperature of the copper alloy material by 50° C. to the highest arrival temperature is set as tm2 (min), relationships of $150 \mathrm{Tmax2} \leq 580$, $0.02 \leq \mathrm{tm2} \leq 100$, and $120 \leq \mathrm{It2} = (\mathrm{Tmax2} - 25 \times \mathrm{tm2}^{-1/2}) \leq 390$ are satisfied. When the Tmax2 is higher than 580° C. or It2 is greater than 390, recrystallization partially occurs, and softening is progressed, and the strength is lowered. The upper limit of Tmax2 is preferably 540° C. or lower, or the lower limit of It2 is 380 or less. When Tmax2 is lower than 150° C. or It2 is less than 120, a degree of an improvement in the stress relaxation characteristics is small. The lower limit of Tmax2 is preferably 250° C. or higher, or the lower limit of It2 is 240 or greater. Further, in the high-temperature and short-time continuous heat treatment method, the heating step and the cooling step may be different, and conditions may be slightly different in accordance with a structure of an apparatus. However, in the above-described ranges, there is no problem.

In a case of being used for a terminal, a connector, and the like, a recovery heat treatment not accompanied with recrystallization is carried out under conditions in which the highest arrival temperature of the rolled material is 150° C. to 580° C., and retention is carried out at a temperature of the highest arrival temperature-50° C. for 0.02 minutes to 100 minutes. Through the low-temperature heat treatment, the stress relaxation characteristics, an elastic limit, conductivity, and mechanical properties are improved. Further, after the finish rolling, in a case where a melting Sn-plating or reflow Sn-plating process, in which heat conditions corresponding to the above-described conditions are added, is carried out after shaping into a sheet material or a product, the recovery heat treatment may be omitted.

Further, the alloy of the invention can also be obtained as follows without carrying out hot-working, specifically, hot-rolling. Specifically, an ingot, which is produced by a continuous casting method and the like, is subjected to homogenization annealing at a high temperature of approximately 700° C. for one hour or longer in some cases, and annealing including cold-rolling and a batch type is repeated. Then, final annealing, finish rolling, and a recovery heat treatment are carried out. A pair of a cold-rolling process and an annealing process may be carried out once or a plurality of times between a casting process and a final annealing process in accordance with the thickness and the like. In addition, as the final annealing, the high-temperature and short-time continuous heat treatment method as described above is preferable. Further, in this specification, working, which is carried out at a temperature lower than a recrystallization temperature of a copper alloy material to be worked, is defined as cold-working, and working, which is carried out at a temperature higher than the recrystallization temperature, is defined as hot-working.

The cold-working and the hot-working, which are carried out for shaping with rolls, are defined as cold-rolling and hot-rolling, respectively. In addition, the recrystallization is defined as a change from one crystalline structure to another crystalline structure, or formation of a crystalline structure without new deformation from a structure with deformation occurring due to working.

Particularly, in a use for a terminal, a connector, a relay, and the like, when a temperature of a rolled material is retained at 150° C. to 580° C. for substantially 0.02 minutes to 100 minutes after the final finish rolling, the stress relaxation characteristics are improved. After shaping into a sheet material or a product after the finish rolling, a Sn-plating process, in which heat conditions corresponding to the above-described conditions are added, is planned to be carried out, the recovery heat treatment may be omitted. In addition, the copper alloy sheet after the recovery heat treatment may be subjected to Sn-plating.

The recovery heat treatment process is a heat treatment of improving an elastic limit of a material, stress relaxation characteristics, a spring deflection limit, and elongation, and of recovering conductivity decreased due to cold-rolling through a low-temperature and short-time recovery heat treatment without being accompanied with recrystallization.

On the other hand, in a case of a typical Cu—Zn alloy containing 18% by mass or greater of Zn, when a cold-worked rolled material is subjected to low-temperature annealing at a reduction of 10% or greater to 40% or less, the rolled material becomes hard and brittle due to low-temperature annealing hardening. When the recovery heat treatment is carried out under conditions of retention for 10 minutes, the rolled material is hardened at 150° C. to 200° C., and is rapidly softened in the vicinity of 250° C. Further, the rolled material is recrystallized at approximately 300° C., and thus the strength decreases to approximately 50% to 65% of the original proof stress of the rolled material. As described above, mechanical properties vary in a narrow temperature range.

Due to an effect of Ni, Sn, and P which are contained in the copper alloys of the embodiments, when retention is carried out, for example, at approximately 200° C. for 10 minutes after the final finish rolling, the strength is slightly raised due to the low-temperature annealing hardening. However, when retention is carried out at approximately 300° C. for 10 minutes, the strength is returned to the original strength of the rolled material, and thus ductility is improved. Here, when the degree of the low-temperature annealing hardening is large, a material becomes brittle similar to the Cu—Zn alloy. In order to avoid this situation, the upper limit of a finish rolling reduction may be 50% or less, preferably 40% or less, and more preferably 35% or less. Further, in order to obtain high strength, the lower limit of the rolling reduction is set to at least 5% or greater, and preferably 10% or greater. The grain size may be 2 μm or greater, and preferably 3 μm or greater. In order to attain the high strength, and in order to improve a balance between the strength and the ductility, the grain size is set to 12 μm or less.

In addition, in a rolled state, a proof stress in a direction perpendicular to the rolling direction is low, but it is possible to improve the proof stress through the recovery heat treatment without deteriorating the ductility. Due to this effect, 10% or greater of difference between the tensile strength and the proof stress in a direction perpendicular to the rolling direction decreases to within 10%. In addition, 10% or greater of difference in the tensile strength or the proof stress between a direction parallel to the rolling direction and a direction perpendicular to the rolling direction decreases to within 10% and approximately 5% from 10% or greater, and thus a material with small anisotropy is obtained.

In this manner, the copper alloy sheets of the embodiments are manufactured.

As described above, in the copper alloys and the copper alloy sheets of the first to third embodiments of the invention, the strength is high, the bending workability is satisfactory, the discoloration resistance is excellent, the stress relaxation characteristics are excellent, and the stress corrosion cracking resistance is also satisfactory. Due to these characteristics, the copper alloys and the copper alloy sheets become a raw material which is excellent in cost performance such as inexpensive metal cost, and a low alloy density, and which is appropriate for parts of electronic and electric apparatuses such as a connector, a terminal, a relay, and a switch, parts of automobiles, metal fitting members for decoration and construction such as a handrail and a door handle, medical instruments, and the like. In addition, the discoloration resistance is satisfactory, and thus plating may be partially omitted. Accordingly, it is possible to utilize an antimicrobial operation of copper in uses for the metal fitting members for decoration and construction such as a handrail, a door handle, and inner wall material of an elevator, medical instruments, and the like.

In addition, an average grain size is 2 μm to 12 μm, conductivity is 18% IACS to 27% IACS, and circular or elliptical precipitates exist. When an average particle size of the precipitates is 3 nm to 180 nm, the strength, and a balance between the strength and the bending workability are more excellent. In addition, the stress relaxation characteristics, particularly, an effective stress at 150° C., is raised, and thus the copper alloys and the copper alloy sheets become a raw material which is appropriate for parts of electronic and electrical apparatuses such as a connector, a terminal, a relay, and a switch, and parts of automobile which are used in a severe environment.

Hereinbefore, embodiments of the invention have been described, but the invention is not limited thereto, and appropriate modification can be made in a range not departing from the technical sprit of the invention.

EXAMPLES

Hereinafter, results of confirmation experiments which were carried out to confirm the effect of the invention will be illustrated. Further, the following examples are provided to illustrate the effect of the invention, and configurations, processes, and conditions which are described in Examples are not intended to limit the technical range of the invention.

Samples were prepared by using the copper alloys according to the first to third embodiments of the invention, and a copper alloys having a composition for comparison, and by changing manufacturing processes.

Compositions of the copper alloys are illustrated in Tables 1 to 4. In addition, the manufacturing processes are illustrated in Table 5. In addition, in Tables 1 to 4, the composition relational expressions f1, f2, f3, f4, f5, and f6 in the above-described embodiments are illustrated.

TABLE 1

| Alloy | Component composition (% by mass) | | | | | | | Composition relational expression | | | | | |
|---|---|---|---|---|---|---|---|---|---|---|---|---|---|
| No. | Zn | Ni | Sn | P | Other elements | | Cu | f1 | f2 | f3 | f4 | f5 | f6 |
| 1 | 27.7 | 1.18 | 0.60 | 0.03 | — | — | Remainder | 28.58 | 23.9 | 11.7 | 1.78 | 2.0 | 39 |
| 2 | 28.0 | 1.41 | 0.47 | 0.02 | — | — | Remainder | 27.81 | 23.5 | 15.2 | 1.88 | 3.0 | 71 |
| 3 | 24.4 | 1.28 | 0.39 | 0.03 | — | — | Remainder | 24.05 | 20.4 | 17.7 | 1.67 | 3.3 | 43 |
| 4 | 19.8 | 1.42 | 0.81 | 0.04 | — | — | Remainder | 21.29 | 15.1 | 21.4 | 2.23 | 1.8 | 36 |
| 11 | 29.5 | 1.15 | 0.48 | 0.04 | — | — | Remainder | 29.60 | 25.8 | 9.7 | 1.63 | 2.4 | 29 |
| 12 | 29.1 | 1.22 | 0.64 | 0.04 | — | — | Remainder | 29.86 | 25.1 | 9.8 | 1.86 | 1.9 | 31 |
| 13 | 28.7 | 1.15 | 0.60 | 0.01 | — | — | Remainder | 29.40 | 25.0 | 10.1 | 1.75 | 1.9 | 115 |
| 14 | 28.2 | 1.40 | 0.80 | 0.04 | — | — | Remainder | 29.40 | 23.6 | 12.2 | 2.20 | 1.8 | 35 |
| 15 | 28.6 | 1.35 | 0.58 | 0.03 | — | — | Remainder | 28.80 | 24.3 | 13.0 | 1.93 | 2.3 | 45 |
| 16 | 27.8 | 1.35 | 0.47 | 0.03 | — | — | Remainder | 27.45 | 23.5 | 15.1 | 1.82 | 2.9 | 45 |
| 17 | 26.5 | 1.25 | 0.50 | 0.02 | — | — | Remainder | 26.50 | 22.5 | 15.1 | 1.75 | 2.5 | 63 |
| 18 | 27.5 | 1.30 | 0.80 | 0.04 | — | — | Remainder | 28.90 | 23.2 | 12.3 | 2.10 | 1.6 | 33 |
| 19 | 25.8 | 1.20 | 0.25 | 0.02 | — | — | Remainder | 24.65 | 22.1 | 16.2 | 1.45 | 4.8 | 60 |
| 20 | 18.8 | 1.15 | 0.38 | 0.03 | — | — | Remainder | 18.40 | 15.2 | 18.2 | 1.53 | 3.0 | 38 |
| 21 | 21.4 | 1.30 | 0.54 | 0.01 | — | — | Remainder | 21.50 | 17.2 | 19.5 | 1.84 | 2.4 | 130 |
| 22 | 23.7 | 1.45 | 0.73 | 0.04 | — | — | Remainder | 24.45 | 19.0 | 19.7 | 2.18 | 2.0 | 36 |
| 23 | 25.2 | 1.28 | 0.46 | 0.02 | — | — | Remainder | 24.94 | 21.1 | 17.0 | 1.74 | 2.8 | 64 |

TABLE 2

| Alloy | Component composition (% by mass) | | | | | | | Composition relational expression | | | | | |
|---|---|---|---|---|---|---|---|---|---|---|---|---|---|
| No. | Zn | Ni | Sn | P | Other elements | | Cu | f1 | f2 | f3 | f4 | f5 | f6 |
| 24 | 26.8 | 1.25 | 0.54 | 0.02 | Fe 0.0009 | — | Remainder | 27.00 | 22.8 | 14.5 | 1.79 | 2.3 | 63 |
| 25 | 28.0 | 1.30 | 0.29 | 0.03 | Fe 0.007 | — | Remainder | 26.85 | 24.0 | 15.3 | 1.59 | 4.5 | 43 |
| 26 | 27.0 | 1.22 | 0.37 | 0.02 | Co 0.004 | — | Remainder | 26.41 | 23.2 | 14.8 | 1.59 | 3.3 | 61 |
| 27 | 26.6 | 1.27 | 0.50 | 0.01 | Al 0.03 | — | Remainder | 26.56 | 22.5 | 15.3 | 1.77 | 2.5 | 127 |
| 28 | 25.8 | 1.42 | 0.80 | 0.02 | Mg 0.02 | — | Remainder | 26.96 | 21.1 | 16.6 | 2.22 | 1.8 | 71 |
| 29 | 27.0 | 1.17 | 0.50 | 0.02 | Mn 0.02 | — | Remainder | 27.16 | 23.2 | 13.4 | 1.67 | 2.3 | 59 |
| 30 | 26.5 | 1.33 | 0.62 | 0.02 | Ti 0.005 | Cr 0.005 | Remainder | 26.94 | 22.2 | 15.5 | 1.95 | 2.1 | 67 |
| 31 | 27.3 | 1.25 | 0.37 | 0.04 | Zr 0.008 | — | Remainder | 26.65 | 23.4 | 14.9 | 1.62 | 3.4 | 31 |
| 32 | 27.2 | 1.35 | 0.45 | 0.02 | Si 0.03 | — | Remainder | 26.75 | 22.9 | 16.0 | 1.80 | 3.0 | 68 |
| 33 | 26.8 | 1.40 | 0.71 | 0.03 | Sb 0.04 | — | Remainder | 27.55 | 22.2 | 15.5 | 2.11 | 2.0 | 47 |
| 34 | 26.5 | 1.25 | 0.58 | 0.02 | As 0.03 | Sb 0.03 | Remainder | 26.90 | 22.5 | 14.6 | 1.83 | 2.2 | 63 |
| 35 | 26.5 | 1.23 | 0.44 | 0.02 | Pb 0.01 | — | Remainder | 26.24 | 22.6 | 15.1 | 1.67 | 2.8 | 62 |
| 36 | 27.2 | 1.27 | 0.45 | 0.02 | Ce 0.01 | — | Remainder | 26.91 | 23.2 | 14.9 | 1.72 | 2.8 | 64 |

TABLE 3

| Alloy | Component composition (% by mass) | | | | | | | Composition relational expression | | | | | |
|---|---|---|---|---|---|---|---|---|---|---|---|---|---|
| No. | Zn | Ni | Sn | P | Other elements | | Cu | f1 | f2 | f3 | f4 | f5 | f6 |
| 101 | 30.6 | 1.15 | 0.25 | 0.02 | — | — | Remainder | 29.55 | 27.0 | 9.8 | 1.40 | 4.6 | 58 |
| 102 | 27.8 | 0.84 | 0.51 | 0.02 | — | — | Remainder | 28.67 | 25.0 | 8.2 | 1.35 | 1.6 | 42 |
| 103 | 27.7 | 1.22 | 0.13 | 0.03 | — | — | Remainder | 25.91 | 24.0 | 15.3 | 1.35 | 9.4 | 41 |
| 104 | 26.5 | 1.25 | 1.15 | 0.03 | — | — | Remainder | 29.75 | 22.2 | 10.2 | 2.40 | 1.1 | 42 |
| 105 | 28.8 | 1.45 | 0.93 | 0.02 | — | — | Remainder | 30.55 | 24.0 | 9.7 | 2.38 | 1.6 | 73 |
| 106 | 29.3 | 1.32 | 0.84 | 0.02 | — | — | Remainder | 30.86 | 24.9 | 7.8 | 2.16 | 1.6 | 66 |
| 107 | 26.9 | 1.30 | 0.75 | 0.08 | — | — | Remainder | 28.05 | 22.6 | 13.7 | 2.05 | 1.7 | 16 |
| 108 | 27.8 | 1.05 | 0.63 | 0.06 | — | — | Remainder | 28.85 | 24.3 | 10.0 | 1.68 | 1.7 | 18 |
| 109 | 26.9 | 1.20 | 0.95 | 0.03 | — | — | Remainder | 29.25 | 22.8 | 10.8 | 2.15 | 1.3 | 40 |
| 110 | 28.6 | 0.79 | 0.52 | 0.03 | — | — | Remainder | 29.62 | 26.0 | 6.6 | 1.31 | 1.5 | 26 |
| 111 | 28.5 | 0.82 | 0.32 | 0.02 | — | — | Remainder | 28.46 | 25.9 | 8.2 | 1.14 | 2.6 | 41 |
| 112 | 16.5 | 1.05 | 0.35 | 0.02 | — | — | Remainder | 16.15 | 13.2 | 16.8 | 1.40 | 3.0 | 53 |
| 113 | 30.5 | 1.48 | 0.48 | 0.04 | — | — | Remainder | 29.94 | 25.8 | 11.6 | 1.96 | 3.1 | 37 |
| 114 | 29.5 | 1.02 | 0.22 | 0.03 | — | — | Remainder | 28.56 | 26.3 | 10.1 | 1.24 | 4.6 | 34 |
| 115 | 29.7 | 1.02 | 0.65 | 0.03 | — | — | Remainder | 30.91 | 26.3 | 5.9 | 1.67 | 1.6 | 34 |
| 116 | 29.6 | 1.45 | 0.24 | 0.04 | — | — | Remainder | 27.90 | 25.1 | 15.5 | 1.69 | 6.0 | 36 |
| 117 | 27.5 | 1.05 | 0.55 | 0.001 | — | — | Remainder | 28.15 | 24.1 | 10.9 | 1.60 | 1.9 | 1050 |

TABLE 4

| Alloy | Component composition (% by mass) | | | | | | | Composition relational expression | | | | | |
|---|---|---|---|---|---|---|---|---|---|---|---|---|---|
| No. | Zn | Ni | Sn | P | Other elements | | Cu | f1 | f2 | f3 | f4 | f5 | f6 |
| 118 | 28.2 | 1.40 | 0.55 | 0.04 | Fe 0.055 | — | Remainder | 28.15 | 23.7 | 14.6 | 1.95 | 2.5 | 35 |
| 119 | 27.3 | 1.32 | 0.48 | 0.03 | Co 0.058 | — | Remainder | 27.06 | 23.1 | 15.3 | 1.80 | 2.8 | 44 |
| 120 | 29.0 | 1.01 | 0.71 | 0.03 | — | — | Remainder | 30.53 | 25.6 | 6.8 | 1.72 | 1.4 | 34 |
| 121 | 28.3 | 1.06 | 0.75 | 0.03 | — | — | Remainder | 29.93 | 24.7 | 8.3 | 1.81 | 1.4 | 35 |
| 201 | 29.7 | — | — | — | — | — | Remainder | — | — | — | — | — | — |
| 202 | 26.0 | — | — | — | — | — | Remainder | — | — | — | — | — | — |
| 203 | 22.5 | — | — | — | — | — | Remainder | — | — | — | — | — | — |
| 204 | 17.8 | — | — | — | — | — | Remainder | — | — | — | — | — | — |
| 205 | — | — | 6.20 | 0.08 | — | — | Remainder | — | — | — | — | — | — |

TABLE 5

| Process No. | Hot-rolling + milling thickness (mm) | Rolling thickness (mm) | Annealing Temperature (° C.) | Annealing Time (min) | Rolling thickness (mm) | Annealing Temperature (° C.) | Annealing Time (min) | Rolling thickness before finish (mm) |
|---|---|---|---|---|---|---|---|---|
| A1-1 | 12 | 2.5 | 580 | 240 | 0.8 | 500 | 240 | 0.36 |
| A1-2 | 12 | 2.5 | 580 | 240 | 0.8 | 500 | 240 | 0.36 |
| A1-3 | 12 | 2.5 | 580 | 240 | 0.8 | 500 | 240 | 0.36 |
| A1-4 | 12 | 2.5 | 580 | 240 | 0.8 | 500 | 240 | 0.36 |
| A2-1 | 12 | — | — | — | 1.0 | 510 | 240 | 0.36 |
| A2-2 | 12 | — | — | — | 1.0 | 510 | 240 | 0.36 |

TABLE 5-continued

| | | | | | | | | |
|---|---|---|---|---|---|---|---|---|
| A2-3 | 12 | — | — | — | 1.0 | 510 | 240 | 0.36 |
| A2-4 | 12 | — | — | — | 1.0 | 510 | 240 | 0.36 |
| A2-5 | 12 | — | — | — | 1.0 | 510 | 240 | 0.36 |
| A2-6 | 12 | — | — | — | 1.0 | 510 | 240 | 0.36 |
| A2-7 | 12 | — | — | — | 1.0 | 510 | 240 | 0.40 |
| A2-8 | 12 | — | — | — | 1.0 | 510 | 240 | 0.40 |
| A2-9 | 12 | — | — | — | 1.0 | 660 | 0.24 | 0.40 |
| A2-10 | 12 | — | — | — | 1.0 | 660 | 0.24 | 0.40 |
| A2-11 | 12 | — | — | — | 1.0 | 660 | 0.24 | 0.36 |
| B1-1 | 6 | — | — | — | 0.9 | 510 | 240 | 0.36 |
| B1-2 | 6 | — | — | — | 0.9 | 510 | 240 | 0.36 |
| B1-3 | 6 | — | — | — | 0.9 | 510 | 240 | 0.36 |
| B1-4 | 6 | — | — | — | 0.72 | 600 | 240 | 0.36 |
| B2-1 | 6 | — | — | — | — | — | — | 0.36 |
| B3-1 | (Annealing) | 6 | 620 | 240 | 0.9 | 510 | 240 | 0.36 |
| B3-2 | (Annealing) | 6 | 620 | 240 | 0.9 | 510 | 240 | 0.36 |
| C1 | 6 | — | — | — | 0.9 | 510 | 240 | 0.36 |
| C1A | 6 | — | — | — | 0.9 | 510 | 240 | 0.36 |
| C2 | 6 | — | — | — | 1.0 | 430 | 240 | 0.40 |

| | Final annealing | | | Finish rolling | | Recovery heat treatment | | |
|---|---|---|---|---|---|---|---|---|
| Process No. | Temperature (° C.) | Time (min) | It1 | Thickness (mm) | Re (%) | Temperature (° C.) | Time (min) | It2 |
| A1-1 | 410 | 240 | — | 0.3 | 17 | 300 | 30 | 295 |
| A1-2 | 410 | 240 | — | 0.3 | 17 | 450 | 0.05 | 338 |
| A1-3 | 410 | 240 | — | 0.3 | 17 | 300 | 0.07 | 188 |
| A1-4 | 690 | 0.12 | 603 | 0.3 | 17 | 450 | 0.05 | 338 |
| A2-1 | 425 | 240 | — | 0.3 | 17 | 450 | 0.05 | 338 |
| A2-2 | 680 | 0.06 | 558 | 0.3 | 17 | 450 | 0.05 | 338 |
| A2-3 | 680 | 0.06 | 558 | 0.3 | 17 | 300 | 0.07 | 188 |
| A2-4 | 680 | 0.06 | 558 | 0.3 | 17 | — | — | — |
| A2-5 | 390 | 240 | — | 0.3 | 17 | 450 | 0.05 | 338 |
| A2-6 | 550 | 240 | — | 0.3 | 17 | 450 | 0.05 | 338 |
| A2-7 | 690 | 0.12 | 603 | 0.3 | 25 | 450 | 0.05 | 338 |
| A2-8 | 690 | 0.12 | 603 | 0.3 | 25 | 250 | 0.15 | 185 |
| A2-9 | 710 | 0.15 | 633 | 0.3 | 25 | 450 | 0.05 | 338 |
| A2-10 | 750 | 0.30 | 695 | 0.3 | 25 | 450 | 0.05 | 338 |
| A2-11 | 620 | 0.05 | 486 | 0.3 | 17 | 450 | 0.05 | 338 |
| B1-1 | 425 | 240 | — | 0.3 | 17 | 450 | 0.05 | 338 |
| B1-2 | 680 | 0.06 | 558 | 0.3 | 17 | 300 | 0.07 | 188 |
| B1-3 | 680 | 0.06 | 558 | 0.3 | 17 | 300 | 30 | 295 |
| B1-4 | 680 | 0.07 | 567 | 0.3 | 17 | 300 | 30 | 295 |
| B2-1 | 425 | 240 | — | 0.3 | 17 | 300 | 30 | 295 |
| B3-1 | 425 | 240 | — | 0.3 | 17 | 300 | 30 | 295 |
| B3-2 | 680 | 0.06 | — | 0 3 | 17 | 300 | 30 | 295 |
| C1 | 425 | 240 | — | 0.3 | 17 | 300 | 30 | 295 |
| C1A | 680 | 0.06 | 558 | 0.3 | 17 | 300 | 30 | 295 |
| C2 | 380 | 240 | — | 0.3 | 25 | 230 | 30 | — |

In manufacturing processes A (A1-1 to A1-4, and A2-1 to A2-11), a raw material was melted in a low-frequency melting furnace having an internal volume of 5 tons, and ingots having a cross-section having a thickness of 190 mm and a width of 630 mm were manufactured through semi-continuous casting. The ingots were cut out in a length of 1.5 m, respectively, and then hot-rolling process (sheet thickness: 13 mm), a cooling process, a milling process (sheet thickness: 12 mm), and a cold-rolling process were carried out.

A hot-rolling initiation temperature in the hot-rolling process was set to 820° C., hot-rolling was carried out up to a sheet thickness of 13 mm, and shower water-cooling was carried out as the cooling process. An average cooling rate in the cooling process was set to a cooling rate in a temperature region from a temperature of a rolled material after final hot-rolling or a temperature of the rolled material of 650° C. to 350° C., and the average cooling rate was measured at a rear end of a rolled sheet. The average cooling rate that was measured was 3° C./second.

In Process A1-1 to Process A1-4, cold-rolling (sheet thickness: 2.5 mm), an annealing process (retention at 580° C. for 4 hours), cold-rolling (sheet thickness: 0.8 mm), an annealing process (retention at 500° C. for 4 hours), a rolling process before finish (sheet thickness: 0.36 mm, cold reduction: 55%), a final annealing process, a finish cold-rolling process (sheet thickness: 0.3 mm, cold reduction: 17%), and a recovery heat treatment process were carried out.

In Process A2-1 to Process A2-6, cold-rolling (sheet thickness: 1 mm), an annealing process (retention at 510° C. for 4 hours), a rolling process before finish (sheet thickness: 0.36 mm, cold reduction: 64%), a final annealing process, a finish cold-rolling process (sheet thickness: 0.3 mm, cold reduction: 17%), and a recovery heat treatment process were carried out.

In Process A2-7 and Process A2-8, cold-rolling (sheet thickness: 1 mm), an annealing process (retention at 510° C. for 4 hours), a rolling process before finish (sheet thickness: 0.4 mm, cold reduction: 60%), a final annealing process, a finish cold-rolling process (sheet thickness: 0.3 mm, cold reduction: 25%), and a recovery heat treatment process were carried out.

In Process A2-9 and Process A2-10, cold-rolling (sheet thickness: 1 mm), an annealing process (high-temperature and short-time annealing (highest arrival temperature Tmax (C)-retention time: tm (min)), (660° C.-0.24 minutes)), a rolling process before finish (sheet thickness: 0.4 mm, cold reduction: 60%), a final annealing process, a finish cold-rolling process (sheet thickness: 0.3 mm, cold reduction: 25%), and a recovery heat treatment process were carried out.

In Process A2-11, cold-rolling (sheet thickness: 1 mm), an annealing process (high-temperature and short-time annealing (highest arrival temperature Tmax (C)-retention time: tm (min)), (660° C.-0.24 minutes)), a rolling process before finish (sheet thickness: 0.36 mm, cold reduction: 64%), a final annealing process, a finish cold-rolling process (sheet thickness: 0.3 mm, cold reduction: 17%), and a recovery heat treatment process were carried out.

The final annealing in Process A1-1 to Process A1-3 was carried out with batch type annealing (retention at 410° C. for 4 hours). In process A1-1, the recovery heat treatment was carried out with a batch type (retention at 300° C. for 30 minutes) in a laboratory. In Process A1-2, the recovery heat treatment was carried out by a continuous high-temperature and short-time annealing method in an actual operating line. When the highest arrival temperature Tmax (° C.) of the rolled material, and the retention time tm (min) in a temperature region from a temperature lower than the highest arrival temperature of the rolled material by 50° C. to the highest arrival temperature were expressed by (highest arrival temperature Tmax (° C.)-retention time tm (min)), the recovery heat treatment was carried out under conditions of (450° C.-0.05 minutes). In Process A1-3, as the recovery heat treatment, the following heat treatment in a laboratory was carried out under conditions of (300° C.-0.07 minutes).

In Process A1-4, the final annealing was carried out by the continuous high-temperature and short-time annealing method in an actual operating line under conditions (highest arrival temperature Tmax (° C.)-retention time tm (min)), (690° C.-0.12 minutes), and the recovery heat treatment was carried out under conditions of (450° C.-0.05 minutes).

The final annealing in Process A2-1 was carried out with batch-type annealing of (retention at 425° C. for 4 hours).

The final annealing in Process A2-5 and the final annealing in Process A2-6 were carried out with (retention at 390° C. for 4 hours) and (retention at 550° C. for 4 hours), respectively, so as to investigate an effect on a grain.

Process A2-2, Process A2-3, and Process A2-4 were carried out by the continuous high-temperature and short-time annealing method under conditions of (680° C.-0.06 minutes). Process A2-11 was carried out by the continuous high-temperature and short-time annealing method under conditions of (620° C.-0.05 minutes).

Process A2-7 to Process A2-10 were carried out by the continuous high-temperature and short-time annealing method. Process A2-7 and Process A2-8 were carried out under conditions of (690° C.-0.12 minutes), Process A2-9 was carried out under conditions of (710° C.-0.15 minutes), and Process A2-10 was carried out under conditions of (750° C.-0.3 minutes).

The recovery heat treatment in Process A2-1, Process A2-2, Process A2-5 to Process A2-7, and Process A2-9 to Process A2-11 was carried out with continuous high-temperature and short-time annealing under conditions of (450° C.-0.05 minutes).

The recovery heat treatment in Process A2-3 and the recovery heat treatment in Process A2-8 were carried out in an laboratory under conditions of (300° C.-0.07 minutes) and (250° C.-0.15 minutes), respectively.

In Process A2-4, the recovery heat treatment was not carried out.

Further, the high-temperature and short-time annealing conditions of (300° C.-0.07 minutes) and (250° C.-0.15 minutes) in Process A2-3 and Process A2-8 are conditions corresponding to a melting Sn-plating process instead of a recovery heat treatment process, and were carried out by a method in which a finish rolled material was immersed in a two-liter oil bath in which a heat treatment oil specified in JIS K 2242: 2012, JIS Grade 3 was heated to 300° C. and 250° C. Further, cooling was carried out with air cooling.

In addition, a manufacturing process B was carried out as follows.

An ingot for a laboratory, which had a thickness of 30 mm, a width of 120 mm, and a length of 190 mm, was cut out from the ingot of the manufacturing process A. The ingot was subjected to a hot-rolling process (sheet thickness: 6 mm), a cooling process (air cooling), a pickling process, a rolling process, an annealing process, a rolling process before finish (thickness: 0.36 mm), a recrystallization heat treatment process, a finish cold-rolling process (sheet thickness: 0.3 mm, reduction: 17%), and a recovery heat treatment process.

In the hot-rolling process, the ingot was heated to 830° C., and was hot-rolled to a thickness of 6 mm. A cooling rate (a cooling rate from a temperature of a rolled material after the hot-rolling or a temperature of the rolled material of 650° C. to 350° C.) in the cooling process was 5° C./second, and a surface was pickled after the cooling process.

In Process B1-1 to Process B1-3, an annealing process was carried out once, cold-rolling was carried out up to 0.9 mm as a rolling process, conditions of the annealing process were set to (retention at 510° C. for 4 hours), and cold-rolling was carried out up to 0.36 mm in a rolling process before finish. Final annealing was carried out under conditions of (retention at 425° C. for 4 hours) in Process B1-1, and was carried out under conditions of (680° C.-0.06 minutes) in Process B1-2 and Process B1-3, and then finish rolling up to 0.3 mm was carried out. In addition, a recovery heat treatment was carried out under conditions of (450° C.-0.05 minutes) in Process B1-1, under conditions of (300° C.-0.07 minutes) in Process B1-2, and under conditions of (retention at 300° C. for 30 minutes) in Process B1-3.

In Process B1-4, cold-rolling (reduction: 88%) was carried out up to 0.72 mm as a rolling process, conditions of an annealing process were set to (retention at 600° C. for 4 hours), cold-rolling (reduction: 50%) was carried out up to 0.36 mm in a rolling process before finish, final annealing was carried out under conditions of (680° C.-0.07 minutes), and finish rolling was carried out up to 0.3 mm. In addition, a recovery heat treatment was carried out under conditions of (retention at 300° C. for 30 minutes).

In Process B2-1, an annealing process was omitted. A sheet material having a thickness of 6 mm after pickling was cold-rolled (reduction: 94%) up to 0.36 mm in a rolling process before finish, final annealing was carried out under conditions of (retention at 425° C. for 4 hours), finish rolling was carried out up to 0.3 mm, and a recovery heat treatment was additionally carried out under conditions of (retention at 300° C. for 30 minutes).

In Process B3-1 and Process B3-2, hot-rolling was not carried out, and cold-rolling and annealing were repetitively carried out. That is, an ingot having a thickness of 30 mm was subjected to homogenization annealing at 720° C. for 4 hours, cold-rolling up to 6 mm, annealing (retention at 620° C. for 4 hours), cold-rolling up to 0.9 mm, annealing (retention at 510° C. for 4 hours), and cold-rolling up to 0.36 mm. Final annealing was carried out under conditions of (retention at 425° C. for 4 hours) in Process B3-1 and under conditions of (680° C.-0.06 minutes) in Process B3-2, and then finish cold-rolling was carried out up to 0.3 mm. In addition, a recovery heat treatment was carried out under conditions of (retention at 300° C. for 30 minutes).

In the manufacturing process B, an annealing process, which corresponds to the short-time heat treatment carried out in the actual operating continuous annealing line in the manufacturing process A and the like, was substituted with immersion of a rolled material in a salt bath. The highest arrival temperature was set to a liquid temperature of the salt bath, and time after complete immersion of the rolled material was set to a retention time, and then air cooling was carried out after the immersion. Further, as the salt (solution), a mixed material of BaCl, KCl, and NaCl was used.

In addition, as a laboratory test, Process C (C1) and Process CA (C1A) were carried out as follows. Melting and casting were carried out in an electric furnace in a laboratory so as to have a predetermined component, thereby obtaining an ingot for test which had a thickness of 30 mm, a width of 120 mm, and a length of 190 mm. Then, manufacturing was carried out by the same process as Process B1-1 described above. That is, the ingot was heated to 830° C., and was hot-rolled up to a thickness of 6 mm. After the hot-rolling, cooling was carried out at a cooling rate at 5° C./second in a temperature range from a temperature of a rolled material after the hot-rolling or 650° C. to 350° C. A surface was pickled after the cooling, and cold-rolling was carried out up to 0.9 mm as a rolling process. After the cold-rolling, an annealing process was carried out under conditions of 510° C. and 4 hours, and cold-rolling was carried out up to 0.36 mm in the subsequent rolling process. Final annealing conditions were set to retention at 425° C. for 4 hours in Process C (C1) and salt bath (680° C.-0.06 minutes) in Process CA (C1A). Then, cold-rolling (cold reduction: 17%) was carried out up to 0.3 mm through finish cold-rolling, and then a recovery heat treatment was carried out under conditions of (retention at 300° C. for 30 minutes).

Further, Process C2 is a process of a comparative material, and was carried out by changing a thickness and heat treatment conditions in accordance with characteristics of a material. After pickling, cold-rolling was carried out up to 1 mm, an annealing process was carried out under conditions of 430° C. and 4 hours, and cold-rolling was carried out up to 0.4 mm as a rolling process. Final annealing conditions were set to retention at 380° C. for 4 hours. Cold-rolling (cold reduction: 25%) was carried out up to 0.3 mm as final cold-rolling, and a recovery heat treatment (retention at 230° C. for 30 minutes) was carried out. With respect to phosphorus bronze (Alloy No. 124) that is a comparative material, commercially available JIS H 3110 C5191R-H which has a thickness of 0.3 mm was used.

As evaluation of the copper alloys, which were prepared in the above-described manufacturing processes, tests for tensile strength, a proof stress, elongation, conductivity, bending workability, a stress relaxation rate, stress corrosion cracking resistance, and discoloration resistance were carried out, and these characteristics were measured.

In addition, a metallographic structure was observed to measure an average grain size, and the percentages of a β-phase and a γ-phase. In addition, an average particle size of precipitates, and the percentage of the number of precipitates having a particle size equal to or less than a predetermined value among the precipitates were measured.

Mechanical Properties

Measurement of the tensile strength, the proof stress, and the elongation was carried out in accordance with a method defined in JIS Z 2201, JIS Z 2241, and a shape of a test specimen was set to No. 5 test specimen. Further, a sample was collected in two directions which are parallel to or perpendicular to the rolling direction. Further, a material that was tested in Process B and Process C had a width of 120 mm, and thus a test was carried out with a test specimen in accordance with the No. 5 test specimen.

Conductivity

Measurement of conductivity was conducted by using a conductivity measuring device (SIGMATEST D2.068) manufactured by Institut Dr. Foerster. Further, in this specification, "electrical conduction" and "conduction" are used with the same meaning. In addition, thermal conductivity and electrical conductivity have a strong relationship. Accordingly, it can be said that the higher the conductivity is, the better the thermal conductivity is.

Bending Workability

The bending workability was evaluated through W-bending defined in JIS H 3110. A bending test (W-bending) was carried out as follows. A bending radius was set to one time (bending radius=0.3 mm, 1t) and 0.5 times (bending radius=0.15 mm, 0.5 t) the thickness of a material. A sample was bent in a direction, a so-called bad way, which forms an angle of 90° with the rolling direction, and in a direction, a so-called good way, which forms an angle of 0° with the rolling direction. In the determination of the bending workability, observation was conducted with a stereoscopic microscope at a magnification of 50 times to determine whether or not cracks are present. A sample in which cracks did not occur under conditions in which the bending radius was 0.5 times the thickness of a material was evaluated as "A", a sample in which cracks did not occur under conditions in which the bending radius was 1 time the thickness of a material was evaluated as "B", and a sample in which cracks occurred under conditions in which the bending radius was 1 time the thickness of a material was evaluated as "C".

Stress Relaxation Characteristics Measurement of a stress relaxation rate was conducted as follows in accordance with JCBA T309: 2004. In a stress relaxation test of a test material, a cantilever screw jig was used. A test specimen was collected in two directions which are parallel to and perpendicular to the rolling direction, respectively, and a shape of the test specimen was set to have a sheet thickness of 0.3 mm×a width of 10 mm×a length of 60 mm. A load stress on the test material was set to be 80% of 0.2% proof stress, and the test material was exposed to an atmosphere of 150° C. and 120° C. for 1,000 hours. The stress relaxation rate was obtained with an expression of stress relaxation rate=(displacement after relief/displacement under a load stress)×100(%), and an average value in test specimens collected from the two directions parallel to and perpendicular to the rolling direction was employed. The invention aims at excellent stress relaxation characteristics even in a Cu—Zn alloy that contains Zn in a high concentration. According to this, when the stress relaxation rate at 150° C. is 30% or less, particularly, 25% or less, the stress relaxation characteristics are excellent, and when the stress relaxation rate is greater than 30% and equal to or less than 40%, the stress relaxation characteristics are satisfactory, and there is no problem for use. In addition, when the stress relaxation rate is greater than 40% and equal to or less than 50%, there is a problem for use. When the stress relaxation rate is greater than 50%, this is a level difficult to use, and is evaluated as "failure". In the invention, a stress relaxation rate of greater than 40% was evaluated as "inappropriate".

On the other hand, in a test under slight mild conditions of 120° C. for 1,000 hours, additionally higher performance is demanded. According to this, when the stress relaxation rate is 14% or less, it can be said that this stress relaxation rate is in a high level, and was evaluated as "A". When the stress relaxation rate is greater than 14% and equal to or less than 21%, it can be said that this stress relaxation rate is satisfactory, and was evaluated as "B". In addition, when the stress relaxation rate is greater than 21% and equal to or less than 40%, there is a problem in use, and when the relaxation rate is greater than 40%, use in a heat environment is substantially difficult even though this heat environment is mild. The invention aims at excellent stress relaxation, and thus a test specimen having a stress relaxation rate greater than 21% was evaluated as "C"

In addition, an effective maximum contact pressure is expressed by proof stress×80%×(100%−stress relaxation rate (%)). In the alloy of the invention, it is necessary for a proof stress at room temperature to be simply high, or it is necessary that not only the stress relaxation rate is low, but also a value of the expression is high. When proof stress× 80%×(100%−stress relaxation rate (%)) is 240 N/mm$^2$ or greater in the test at 150° C., use in a high-temperature state is "possible", 270 N/mm or greater is "appropriate", and 300 N/mm$^2$ or greater is "optimal". With regard to the proof stress and the stress relaxation characteristics, from a relationship of a slitted width after slitting, that is, in a case where the width is less than 60 mm, it may be difficult to collect a test specimen in a direction that forms 90° (perpendicular) with respect to the rolling direction. In this case, in the test specimen, it is assumed that the stress relaxation characteristics and the effective maximum contact pressure are evaluated only in a direction that forms 0° (parallel) with respect to the rolling direction.

Further, in Test Nos. 22, 26, and 31 (Alloy No. 2), and Test Nos. 44 and 45 (Alloy No. 3), it was confirmed that there is no greater difference between an effective stress calculated from results in stress relaxation tests in a direction that forms 900 (perpendicular) with respect to the rolling direction and in a direction that forms 00 (parallel) with respect to the rolling direction, an effective stress calculated from a result in a stress relaxation test only in a direction that forms 00 (parallel) with respect to the rolling direction, and an effective stress calculated from a result in a stress relaxation test only in a direction that forms 900 (perpendicular) with respect to the rolling direction.

In the alloy of the invention, it is preferable to accomplish the above-described three determination criteria.

Stress Corrosion Cracking

Measurement of the stress corrosion cracking characteristics was conducted by using a test container which is defined in ASTMB858-01. Specifically, the measurement was conducted after adding a test solution, that is, sodium hydroxide to 107 g/500 ml of ammonium chloride to adjust pH to 10.1±0.1, and adjusting indoor air to 22±1° C.

In a stress corrosion cracking test, a cantilever strew jig formed from a resin was used to investigate susceptibility to the stress corrosion cracking in a state in which a stress was applied. As is the case with the stress relaxation test, a rolled material, to which a bending stress that is 80% of the proof stress, that is, a stress that is an elastic limit of a material was applied, was exposed to the stress corrosion cracking atmosphere, and then evaluation of the stress corrosion cracking resistance was conducted from the stress relaxation rate. That is, when fine cracks occur, the rolled material does not return to the original state, and when as the degree of the cracks increases, the stress relaxation rate also increases. Accordingly, it is possible to evaluate the stress corrosion cracking resistance. After exposure for 24 hours, a stress relaxation rate of 15% or less was regarded as excellent in the stress corrosion cracking resistance and was evaluated as "A". A stress relaxation rate of greater than 15% and equal to or less than 30% was regarded as satisfactory in the stress corrosion cracking resistance, and was evaluated as "B". A stress relaxation rate of greater than 30% was regarded as difficult in use in a severe stress corrosion cracking environment, and was evaluated as "C". In addition, in the evaluation, a sample was collected in a direction parallel to the rolling direction.

Structure Observation

In measurement of an average grain size of grains, an appropriate magnification such as 300 times, 600 times, and 150 times in a metallographic microscope photograph was selected in accordance with the size of the grains, and then the measurement was conducted in accordance with a quadrature method in methods for estimating an average grain size of wrought copper and copper alloys which is defined in JIS H 0501. Further, a twin crystal is not regarded as a grain.

Further, one grain is elongated due to rolling, but a volume of the grain hardly varies due to the rolling.

In a cross-section after cutting a sheet material in a direction parallel to the rolling direction, it is possible to estimate an average grain size at a recrystallization stage from an average grain size measured in accordance with the quadrature method.

An α-phase ratio in each alloy was determined with a metallographic microscope photograph (visual field: 89 mm×127 mm) at a magnification of 300 times. As described above, discrimination of the respective α-phase, β-phase, and γ-phase is easy in a state of also including a non-metallic inclusion, and the like. With respect to an alloy and a sample in which the β-phase or the γ-phase exists, a metallographic structure observed was subject to binarization processing with respect to the β-phase and the γ-phase by using image processing software "WinROOF". The percentage of the area of the β-phase and the γ-phase with respect to the entire area of the metallographic structure was set as an area ratio, and the α-phase ratio was obtained by subtracting the total area ratio of the β-phase and the γ-phase from 100%. Further, the metallographic structure was subjected to three-visual field measurement to calculate an average value of respective area ratios.

Precipitates

An average particle size of the precipitates was obtained as follows. A transmission electron image obtained by TEM set to a magnification of 150,000 times (detection limit: 2 nm) was analyzed with image analysis software "Win ROOF" for elliptical approximation of the contrast of the precipitates, a geometric mean value of the major axis and the minor axis was obtained with respect to all precipitate particles in the visual field, and the mean value was set as an average particle size. With respect to an average particle size of the precipitates which is less than approximately 5 nm, the magnification was set to 750,000 times (detection limit: 0.5 nm), and with respect to an average particle size of the precipitates which is greater than approximately 100 nm, the magnification was set to 50,000 times (detection limit: 6 nm). In a case of the transmission electron microscope, a dislocation density is high in a cold-worked material, and thus it is difficult to accurately grasp information of the precipitates. In addition, the size of the precipitates does not vary during cold-working, and thus in this observation, a recrystallized portion after a recrystallization heat treatment process before the finish cold-rolling process was observed. A measurement position was set to two sites located at depth ¼ times the sheet thickness from both surfaces including a front surface and a rear surface of the rolled material, and measurement values at the two sites were averaged.

Discoloration Resistance Test: High-Temperature and High-Humidity Atmosphere Test In a discoloration resistance test conducted for evaluating the discoloration resistance of a material, each sample was exposed to an atmosphere of a temperature of 60° C. and relative humidity of 95% by using a constant-temperature and constant-humidity bath (HIFLEX FX2050, manufactured by Kusumoto Chemicals, Ltd.). A test time was set to 24 hours, and a sample was taken out after the test. Then, a surface color of a material before and after exposure, that is, L*a*b*, was measured by a spectrophotometer, and a color difference between before exposure and after exposure was calculated and evaluated. In a Cu—Zn alloy containing Zn in a high concentration, the discoloration becomes reddish brown or red. Accordingly, as evaluation of the corrosion resistance, with respect to a difference in a* between before the test and after the test, that is, a variation value, a variation value less than 1 was evaluated as "A", a variation value of 1 or more and less than 2 was evaluated as "B", and a variation value of 2 or more was evaluated as "C". The color difference indicates a difference in a measured value between before the test and after the test. As a numerical value is greater, it can be determined that the discoloration resistance is inferior, and this result well matches evaluation with the naked eye.

Color Tone and Color Difference

With regard to the surface color (color tone) of the copper alloy which was evaluated in the above-described discoloration resistance test, a method of measuring an object color in accordance with JIS Z 8722-2009 (Methods of color measurement-Reflecting and transmitting objects) was executed, and results were expressed by an L*a*b* color space defined in JIS Z 8729-2004 (Color Specification-Cielab And Cieluv Color Spaces).

Specifically, values of L, a, and b before and after the test were measured and evaluated in a SCI (including specular reflection light) manner by using a spectrophotometer (CM-700d, manufactured by Konica Minolta, Inc.). Further, in the measurement of L*a*b* before and after the test, three points were measured, and an average value thereof was used.

Evaluation results are illustrated in Tables 6 to 21. Here, Alloy Nos. 1 to 36, and Test Nos. 1 to 18, 21 to 37, 41 to 57, 61 to 78, and 101 to 126 correspond to the copper alloy of the invention.

TABLE 6

| | | | Structure observation | | | | Stress relaxation characteristics | | | | |
|---|---|---|---|---|---|---|---|---|---|---|---|
| Test No. | Manufacturing process | Alloy No. | α-phase ratio (%) | Average grain size (μm) | Average particle size of precipitates (nm) | Conductivity (% IACS) | 150° C. × 1000 hours (%) | 120° C. × 1000 hours (evaluation) | Effective stress (N/mm$^2$) | Stress corrosion cracking (evaluation) | Discoloration resistance (evaluation) |
| 1 | A1-1 | 1 | 100 | 3 | 25 | 21 | 32 | A | 305 | B | A |
| 2 | A1-2 | | 100 | 3 | 25 | 21 | 33 | B | 301 | B | — |
| 3 | A1-3 | | 100 | 3 | 25 | 21 | 36 | B | 291 | B | — |
| 4 | A1-4 | | 100 | 6 | 75 | 21 | 27 | A | 311 | B | — |
| 5 | A2-1 | | 100 | 4 | 30 | 21 | 33 | A | 297 | B | — |
| 6 | A2-2 | | 100 | 4 | 35 | 21 | 30 | A | 309 | B | — |
| 7 | A2-3 | | 100 | 4 | 35 | 21 | 32 | A | 305 | B | — |
| 8 | A2-4 | | 100 | 4 | 35 | 20 | — | — | — | B | A |
| 9 | A2-5 | | 100 | 1.5 | 7 | 21 | 38 | B | 303 | B | — |
| 10 | A2-6 | | 100 | 18 | 250 | 22 | 37 | B | 238 | B | — |
| 11 | A2-7 | | 100 | 6 | 70 | 20 | 28 | A | 338 | B | — |
| 12 | A2-8 | | 100 | 6 | 70 | 20 | 33 | A | 315 | B | — |
| 13 | B1-1 | | 100 | 4 | 35 | 21 | 32 | A | 301 | B | A |
| 14 | B1-2 | | 100 | 4 | 40 | 20 | 32 | B | 303 | B | — |
| 15 | B1-3 | | 100 | 4 | 40 | 21 | 27 | A | 324 | B | — |
| 16 | B1-4 | | 100 | 6 | 110 | 21 | 38 | B | 249 | C | — |
| 17 | B2-1 | | 100 | 3 | 20 | 21 | 34 | B | 298 | B | A |
| 18 | B3-1 | | 100 | 5 | 70 | 21 | 34 | B | 285 | B | A |

TABLE 7

| | | | Structure observation | | | | Stress relaxation characteristics | | | | |
|---|---|---|---|---|---|---|---|---|---|---|---|
| Test No. | Manufacturing process | Alloy No. | α-phase ratio (%) | Average grain size (μm) | Average particle size of precipitates (nm) | Conductivity (% IACS) | 150° C. × 1000 hours (%) | 120° C. × 1000 hours (evaluation) | Effective stress (N/mm$^2$) | Stress corrosion cracking (evaluation) | Discoloration resistance (evaluation) |
| 21 | A1-1 | 2 | 100 | 3 | 25 | 21 | 28 | A | 322 | B | A |
| 22 | A1-2 | | 100 | 3 | 25 | 21 | 29 | A | 318 | B | — |
| 23 | A1-3 | | 100 | 3 | 25 | 21 | 33 | A | 302 | B | — |
| 24 | A1-4 | | 100 | 6 | 80 | 21 | 21 | A | 335 | B | — |
| 25 | A2-1 | | 100 | 4 | 30 | 21 | 28 | A | 319 | B | — |

TABLE 7-continued

| Test No. | Manufacturing process | Alloy No. | Structure observation: α-phase ratio (%) | Structure observation: Average grain size (μm) | Structure observation: Average particle size of precipitates (nm) | Conductivity (% IACS) | Stress relaxation characteristics: 150° C. × 1000 hours (%) | Stress relaxation characteristics: 120° C. × 1000 hours (evaluation) | Stress relaxation characteristics: Effective stress (N/mm$^2$) | Stress corrosion cracking (evaluation) | Discoloration resistance (evaluation) |
|---|---|---|---|---|---|---|---|---|---|---|---|
| 26 | A2-2 | | 100 | 4 | 35 | 21 | 23 | A | 339 | B | — |
| 27 | A2-3 | | 100 | 4 | 35 | 21 | 26 | A | 332 | B | — |
| 28 | A2-4 | | 100 | 4 | 35 | 20 | — | — | — | B | A |
| 29 | A2-5 | | 100 | 1.5 | 6 | 21 | 37 | B | 312 | B | — |
| 30 | A2-6 | | 100 | 15 | 200 | 22 | 36 | B | 246 | B | — |
| 31 | A2-7 | | 100 | 6 | 80 | 20 | 22 | A | 365 | B | — |
| 32 | A2-8 | | 100 | 6 | 80 | 20 | 26 | A | 352 | B | — |
| 32A | A2-9 | | 100 | 9 | 100 | 20 | 20 | A | 367 | B | A |
| 32B | A2-10 | | 100 | 15 | 150 | 19 | 25 | A | 338 | B | — |
| 32C | A2-11 | | 100 | 1.5 | 5 | 21 | 31 | A | 335 | B | — |
| 33 | B1-1 | | 100 | 4 | 35 | 21 | 28 | A | 318 | B | A |
| 34 | B1-2 | | 100 | 4 | 45 | 20 | 26 | A | 329 | B | — |
| 35 | B1-3 | | 100 | 4 | 45 | 21 | 21 | A | 350 | B | — |
| 36 | B2-1 | | 100 | 3 | 25 | 21 | 29 | A | 319 | B | A |
| 37 | B3-1 | | 100 | 5 | 65 | 21 | 30 | A | 298 | B | A |
| 37A | B3-2 | | 100 | 4 | 60 | 21 | 27 | A | 318 | B | A |

TABLE 8

| Test No. | Manufacturing process | Alloy No. | Structure observation: α-phase ratio (%) | Structure observation: Average grain size (μm) | Structure observation: Average particle size of precipitates (nm) | Conductivity (% IACS) | Stress relaxation characteristics: 150° C. × 1000 hours (%) | Stress relaxation characteristics: 120° C. × 1000 hours (evaluation) | Stress relaxation characteristics: Effective stress (N/mm$^2$) | Stress corrosion cracking (evaluation) | Discoloration resistance (evaluation) |
|---|---|---|---|---|---|---|---|---|---|---|---|
| 41 | A1-1 | 3 | 100 | 4 | 40 | 23 | 27 | A | 311 | A | A |
| 42 | A1-2 | | 100 | 4 | 40 | 23 | 28 | A | 307 | A | — |
| 43 | A1-3 | | 100 | 4 | 40 | 23 | 32 | A | 292 | A | — |
| 44 | A1-4 | | 100 | 8 | 75 | 22 | 23 | A | 312 | A | — |
| 45 | A2-1 | | 100 | 5 | 30 | 23 | 28 | A | 303 | A | — |
| 46 | A2-2 | | 100 | 5 | 35 | 23 | 25 | A | 315 | A | — |
| 47 | A2-3 | | 100 | 5 | 35 | 22 | 26 | A | 318 | A | — |
| 48 | A2-4 | | 100 | 5 | 35 | 22 | — | — | — | A | A |
| 49 | A2-5 | | 100 | 1.5 | 10 | 23 | 34 | A | 306 | A | — |
| 50 | A2-6 | | 100 | 18 | 220 | 24 | 34 | B | 244 | B | — |
| 51 | A2-7 | | 100 | 7 | 80 | 22 | 24 | A | 339 | A | — |
| 52 | A2-8 | | 100 | 7 | 80 | 22 | 27 | A | 332 | A | — |
| 52A | A2-9 | | 100 | 9 | 90 | 21 | 23 | A | 338 | A | A |
| 52B | A2-10 | | 100 | 15 | 180 | 20 | 26 | A | 312 | A | — |
| 52C | A2-11 | | 100 | 1.5 | 4 | 23 | 29 | A | 325 | A | — |
| 53 | B1-1 | | 100 | 4 | 35 | 23 | 28 | A | 303 | A | A |
| 54 | B1-2 | | 100 | 4 | 40 | 22 | 26 | A | 316 | A | — |
| 55 | B1-3 | | 100 | 4 | 40 | 22 | 24 | A | 320 | A | — |
| 56 | B2-1 | | 100 | 4 | 30 | 23 | 28 | A | 307 | A | A |
| 57 | B3-1 | | 100 | 5 | 60 | 23 | 29 | A | 295 | A | A |
| 57A | B3-2 | | 100 | 5 | 65 | 22 | 26 | A | 310 | A | A |

TABLE 9

| Test No. | Manufacturing process | Alloy No. | Structure observation: α-phase ratio (%) | Structure observation: Average grain size (μm) | Structure observation: Average particle size of precipitates (nm) | Conductivity (% IACS) | Stress relaxation characteristics: 150° C. × 1000 hours (%) | Stress relaxation characteristics: 120° C. × 1000 hours (evaluation) | Stress relaxation characteristics: Effective stress (N/mm$^2$) | Stress corrosion cracking (evaluation) | Discoloration resistance (evaluation) |
|---|---|---|---|---|---|---|---|---|---|---|---|
| 61 | A1-1 | 4 | 100 | 3 | 25 | 22 | 26 | A | 311 | A | A |
| 62 | A1-2 | | 100 | 3 | 25 | 22 | 26 | A | 311 | A | — |
| 63 | A1-3 | | 100 | 3 | 25 | 22 | 29 | A | 302 | A | — |
| 64 | A1-4 | | 100 | 5 | 70 | 21 | 21 | A | 318 | A | — |
| 65 | A2-1 | | 100 | 4 | 30 | 22 | 26 | A | 307 | A | — |

TABLE 9-continued

| Test No. | Manufacturing process | Alloy No. | Structure observation: α-phase ratio (%) | Structure observation: Average grain size (μm) | Structure observation: Average particle size of precipitates (nm) | Conductivity (% IACS) | Stress relaxation characteristics: 150° C. × 1000 hours (%) | Stress relaxation characteristics: 120° C. × 1000 hours (evaluation) | Stress relaxation characteristics: Effective stress (N/mm$^2$) | Stress corrosion cracking (evaluation) | Discoloration resistance (evaluation) |
|---|---|---|---|---|---|---|---|---|---|---|---|
| 66 | A2-2 | | 100 | 4 | 35 | 22 | 23 | A | 318 | A | — |
| 67 | A2-3 | | 100 | 4 | 35 | 22 | 24 | A | 320 | A | — |
| 68 | A2-4 | | 100 | 4 | 35 | 21 | — | — | — | A | A |
| 69 | A2-5 | | 100 | 1.5 | 7 | 22 | 34 | B | 308 | A | — |
| 70 | A2-6 | | 100 | 15 | 230 | 23 | 34 | B | 235 | A | — |
| 71 | A2-7 | | 100 | 5 | 70 | 21 | 22 | A | 343 | A | — |
| 72 | A2-8 | | 100 | 5 | 70 | 21 | 25 | A | 333 | A | — |
| 73 | B1-1 | | 100 | 4 | 45 | 22 | 27 | A | 303 | A | A |
| 74 | B1-2 | | 100 | 4 | 50 | 21 | 26 | A | 311 | A | — |
| 75 | B1-3 | | 100 | 4 | 50 | 21 | 21 | A | 329 | A | — |
| 76 | B1-4 | | 100 | 7 | 120 | 22 | 29 | A | 273 | A | — |
| 77 | B2-1 | | 100 | 3 | 30 | 22 | 27 | A | 306 | A | A |
| 78 | B3-1 | | 100 | 4 | 50 | 22 | 26 | A | 307 | A | A |
| 78B | B3-2 | | 100 | 4 | 60 | 21 | 26 | A | 311 | A | A |

TABLE 10

| Test No. | Manufacturing process | Alloy No. | Structure observation: α-phase ratio (%) | Structure observation: Average grain size (μm) | Structure observation: Average particle size of precipitates (nm) | Conductivity (% IACS) | Stress relaxation characteristics: 150° C. × 1000 hours (%) | Stress relaxation characteristics: 120° C. × 1000 hours (evaluation) | Stress relaxation characteristics: Effective stress (N/mm$^2$) | Stress corrosion cracking (evaluation) | Discoloration resistance (evaluation) |
|---|---|---|---|---|---|---|---|---|---|---|---|
| 101 | C1 | 11 | 100 | 4 | 40 | 21 | 39 | B | 271 | B | B |
| 102 | C1 | 12 | 100 | 4 | 45 | 21 | 38 | B | 281 | B | A |
| 103 | C1 | 13 | 100 | 4 | 50 | 21 | 36 | B | 286 | B | A |
| 103A | C1A | 13 | 100 | 4 | — | 20 | 34 | B | 296 | B | A |
| 104 | C1 | 14 | 100 | 4 | 35 | 20 | 33 | B | 296 | B | A |
| 105 | C1 | 15 | 100 | 4 | 40 | 21 | 30 | A | 311 | B | A |
| 106 | C1 | 16 | 100 | 4 | 40 | 21 | 28 | A | 317 | B | A |
| 106A | C1A | 16 | 100 | 4 | — | 20 | 25 | A | 331 | B | A |
| 107 | C1 | 17 | 100 | 4 | 40 | 22 | 27 | A | 317 | B | A |
| 108 | C1 | 18 | 100 | 4 | 40 | 20 | 36 | B | 283 | B | A |
| 109 | C1 | 19 | 100 | 5 | 60 | 24 | 33 | B | 278 | B | A |
| 110 | C1 | 20 | 100 | 4 | 35 | 25 | 26 | A | 284 | A | B |
| 111 | C1 | 21 | 100 | 4 | 35 | 23 | 25 | A | 300 | A | A |
| 112 | C1 | 22 | 100 | 4 | 35 | 21 | 25 | A | 319 | A | A |
| 112A | C1A | 22 | 100 | 4 | — | 21 | 23 | A | 330 | A | A |
| 113 | C1 | 23 | 100 | 4 | 35 | 22 | 26 | A | 313 | A | A |

TABLE 11

| Test No. | Manufacturing process | Alloy No. | Structure observation: α-phase ratio (%) | Structure observation: Average grain size (μm) | Structure observation: Average particle size of precipitates (nm) | Conductivity (% IACS) | Stress relaxation characteristics: 150° C. × 1000 hours (%) | Stress relaxation characteristics: 120° C. × 1000 hours (evaluation) | Stress relaxation characteristics: Effective stress (N/mm$^2$) | Stress corrosion cracking (evaluation) | Discoloration resistance (evaluation) |
|---|---|---|---|---|---|---|---|---|---|---|---|
| 114 | C1 | 24 | 100 | 3 | 20 | 22 | 30 | A | 312 | B | A |
| 115 | C1 | 25 | 100 | 3 | 10 | 22 | 30 | A | 315 | B | A |
| 116 | C1 | 26 | 100 | 3 | 15 | 22 | 29 | A | 320 | B | A |
| 116A | C1A | 26 | 100 | 3 | 12 | 21 | 27 | A | 331 | B | A |
| 117 | C1 | 27 | 100 | 3 | 20 | 22 | 29 | A | 316 | B | A |
| 118 | C1 | 28 | 100 | 3 | 25 | 20 | 27 | A | 327 | A | A |
| 119 | C1 | 29 | 100 | 4 | 35 | 22 | 32 | A | 301 | B | A |
| 120 | C1 | 30 | 100 | 3 | 30 | 21 | 28 | A | 322 | B | A |
| 121 | C1 | 31 | 100 | 3 | 30 | 22 | 29 | A | 314 | B | A |
| 122 | C1 | 32 | 100 | 3 | 25 | 22 | 27 | A | 326 | B | A |
| 123 | C1 | 33 | 100 | 4 | 35 | 20 | 26 | A | 329 | A | A |
| 124 | C1 | 34 | 100 | 4 | 35 | 22 | 29 | A | 312 | A | A |

TABLE 11-continued

| Test No. | Manufacturing process | Alloy No. | Structure observation: α-phase ratio (%) | Structure observation: Average grain size (μm) | Structure observation: Average particle size of precipitates (nm) | Conductivity (% IACS) | Stress relaxation characteristics: 150° C. × 1000 hours (%) | Stress relaxation characteristics: 120° C. × 1000 hours (evaluation) | Stress relaxation characteristics: Effective stress (N/mm$^2$) | Stress corrosion cracking (evaluation) | Discoloration resistance (evaluation) |
|---|---|---|---|---|---|---|---|---|---|---|---|
| 125 | C1 | 35 | 100 | 4 | 40 | 22 | 29 | A | 310 | B | A |
| 126 | C1 | 36 | 100 | 3 | 25 | 22 | 30 | A | 311 | B | A |

TABLE 12

| Test No. | Manufacturing process | Alloy No. | Structure observation: α-phase ratio (%) | Structure observation: Average grain size (μm) | Structure observation: Average particle size of precipitates (nm) | Conductivity (% IACS) | Stress relaxation characteristics: 150° C. × 1000 hours (%) | Stress relaxation characteristics: 120° C. × 1000 hours (evaluation) | Stress relaxation characteristics: Effective stress (N/mm$^2$) | Stress corrosion cracking (evaluation) | Discoloration resistance (evaluation) |
|---|---|---|---|---|---|---|---|---|---|---|---|
| 201 | C1 | 101 | 100 | 3 | 60 | 22 | 43 | C | 247 | C | B |
| 201A | C1A | 101 | 99.9 | 3 | — | 21 | 48 | C | 229 | C | C |
| 202 | C1 | 102 | 100 | 4 | 45 | 23 | 48 | C | 223 | C | B |
| 203 | C1 | 103 | 100 | 5 | 80 | 23 | 41 | B | 236 | B | B |
| 204 | C1 | 104 | 99.5 | 3 | 55 | 19 | 49 | C | 228 | C | C |
| 205 | C1 | 105 | 99.6 | 3 | 50 | 19 | 50 | C | 224 | C | B |
| 206 | C1 | 106 | 99.5 | 3 | 45 | 19 | 56 | C | 196 | C | B |
| 207 | C1 | 107 | 100 | 3 | 25 | 21 | 40 | B | 274 | B | A |
| 208 | C1 | 108 | 100 | 3 | 35 | 22 | 42 | B | 255 | B | A |
| 209 | C1 | 109 | 100 | 4 | 35 | 20 | 48 | C | 229 | B | A |
| 210 | C1 | 110 | 100 | 4 | 45 | 23 | 53 | C | 202 | C | C |
| 211 | C1 | 111 | 100 | 5 | 70 | 24 | 45 | C | 229 | C | C |
| 211A | C1A | 111 | 100 | 5 | — | 23 | 42 | C | 240 | C | C |
| 212 | C1 | 112 | 100 | 5 | 50 | 27 | 33 | B | 237 | A | C |
| 213 | C1 | 113 | 100 | 4 | 35 | 20 | 44 | C | 250 | C | A |
| 214 | C1 | 114 | 100 | 5 | 40 | 23 | 45 | C | 225 | C | C |
| 215 | C1 | 115 | 99.8 | 4 | 40 | 21 | 50 | C | 222 | C | B |
| 216 | C1 | 116 | 100 | 4 | 35 | 21 | 43 | C | 243 | B | A |
| 217 | C1 | 117 | 100 | 6 | | 22 | 54 | C | 195 | C | B |

TABLE 13

| Test No. | Manufacturing process | Alloy No. | Structure observation: α-phase ratio (%) | Structure observation: Average grain size (μm) | Structure observation: Average particle size of precipitates (nm) | Conductivity (% IACS) | Stress relaxation characteristics: 150° C. × 1000 hours (%) | Stress relaxation characteristics: 120° C. × 1000 hours (evaluation) | Stress relaxation characteristics: Effective stress (N/mm$^2$) | Stress corrosion cracking (evaluation) | Discoloration resistance (evaluation) |
|---|---|---|---|---|---|---|---|---|---|---|---|
| 218 | C1 | 118 | 100 | 1.5 | 2.5 | 21 | 40 | B | 294 | B | A |
| 219 | C1 | 119 | 100 | 1.5 | 2.5 | 22 | 39 | B | 297 | B | A |
| 220 | C1 | 120 | 99.9 | 4.0 | — | 21 | 51 | C | 216 | C | B |
| 220A | C1A | 120 | 99.6 | 4.0 | — | 20 | 56 | C | 196 | C | C |
| 221 | C1 | 121 | 100 | 5.0 | — | 120 | 45 | C | 244 | B | B |
| 221A | C1A | 121 | 99.8 | 5.0 | — | 120 | 49 | C | 229 | C | B |
| 301 | C2 | 201 | 100 | 7 | — | 28 | 84 | C | 62 | C | C |
| 302 | C2 | 202 | 100 | 6 | — | 29 | 80 | C | 77 | C | C |
| 303 | C2 | 203 | 100 | 7 | — | 31 | 77 | C | 87 | B | C |
| 304 | C2 | 204 | 100 | 9 | — | 34 | 73 | C | 97 | A | C |
| 305 | — | 205 | 100 | 15 | — | 14 | 62 | C | 172 | A | C |

TABLE 14

| Test No. | Manufacturing process | Alloy No. | Parallel to rolling direction: Tensile strength $TS_P$ (N/mm$^2$) | Parallel to rolling direction: Proof stress $YS_P$ (N/mm$^2$) | Parallel to rolling direction: Elongation (%) | Perpendicular to rolling direction: Tensile strength $TS_O$ (N/mm$^2$) | Perpendicular to rolling direction: Proof stress $YS_O$ (N/mm$^2$) | Perpendicular to rolling direction: Elongation (%) | Bending workability: Good Way (evaluation) | Bending workability: Bad Way (evaluation) |
|---|---|---|---|---|---|---|---|---|---|---|
| 1 | A1-1 | 1 | 605 | 555 | 15 | 622 | 568 | 11 | A | A |
| 2 | A1-2 | | 608 | 558 | 14 | 624 | 565 | 10 | A | A |
| 3 | A1-3 | | 618 | 566 | 13 | 627 | 569 | 10 | A | B |
| 4 | A1-4 | | 572 | 530 | 21 | 588 | 534 | 15 | A | A |
| 5 | A2-1 | | 590 | 547 | 17 | 613 | 562 | 11 | A | A |
| 6 | A2-2 | | 588 | 544 | 18 | 608 | 560 | 12 | A | A |
| 7 | A2-3 | | 601 | 557 | 15 | 623 | 566 | 10 | A | A |
| 8 | A2-4 | | 580 | 544 | 17 | 603 | 552 | 10 | A | B |
| 9 | A2-5 | | 658 | 602 | 9 | 681 | 618 | 5 | B | C |
| 10 | A2-6 | | 518 | 457 | 22 | 551 | 486 | 12 | A | C |
| 11 | A2-7 | | 620 | 582 | 12 | 644 | 590 | 9 | A | B |
| 12 | A2-8 | | 625 | 587 | 11 | 650 | 589 | 9 | A | B |
| 13 | B1-1 | | 587 | 545 | 17 | 605 | 561 | 11 | A | A |
| 14 | B1-2 | | 593 | 547 | 16 | 619 | 568 | 9 | A | B |
| 15 | B1-3 | | 584 | 543 | 18 | 606 | 566 | 12 | A | A |
| 16 | B1-4 | | 544 | 485 | 15 | 603 | 521 | 10 | A | B |
| 17 | B2-1 | | 599 | 554 | 15 | 631 | 573 | 10 | A | A |
| 18 | B3-1 | | 580 | 533 | 18 | 600 | 545 | 12 | A | A |

TABLE 15

| Test No. | Manufacturing process | Alloy No. | Parallel to rolling direction: Tensile strength $TS_P$ (N/mm$^2$) | Parallel to rolling direction: Proof stress $YS_P$ (N/mm$^2$) | Parallel to rolling direction: Elongation (%) | Perpendicular to rolling direction: Tensile strength $TS_O$ (N/mm$^2$) | Perpendicular to rolling direction: Proof stress $YS_O$ (N/mm$^2$) | Perpendicular to rolling direction: Elongation (%) | Bending workability: Good Way (evaluation) | Bending workability: Bad Way (evaluation) |
|---|---|---|---|---|---|---|---|---|---|---|
| 21 | A1-1 | 2 | 602 | 551 | 15 | 615 | 567 | 11 | A | A |
| 22 | A1-2 | | 604 | 554 | 14 | 618 | 564 | 10 | A | A |
| 23 | A1-3 | | 612 | 562 | 12 | 622 | 563 | 10 | A | A |
| 24 | A1-4 | | 570 | 528 | 21 | 581 | 532 | 15 | A | A |
| 25 | A2-1 | | 586 | 544 | 17 | 608 | 563 | 11 | A | A |
| 26 | A2-2 | | 585 | 542 | 18 | 604 | 560 | 12 | A | A |
| 27 | A2-3 | | 597 | 555 | 15 | 617 | 567 | 9 | A | A |
| 28 | A2-4 | | 584 | 540 | 17 | 600 | 551 | 11 | A | A |
| 29 | A2-5 | | 658 | 605 | 9 | 694 | 635 | 5 | B | C |
| 30 | A2-6 | | 517 | 465 | 20 | 556 | 494 | 13 | A | B |
| 31 | A2-7 | | 615 | 574 | 11 | 648 | 597 | 9 | A | B |
| 32 | A2-8 | | 626 | 583 | 11 | 657 | 605 | 8 | A | B |
| 32A | A2-9 | | 607 | 565 | 13 | 634 | 583 | 10 | A | A |
| 32B | A2-10 | | 590 | 549 | 12 | 623 | 576 | 8 | A | C |
| 32C | A2-11 | | 642 | 599 | 9 | 675 | 614 | 6 | B | C |
| 33 | B1-1 | | 585 | 543 | 18 | 608 | 560 | 11 | A | A |
| 34 | B1-2 | | 594 | 547 | 16 | 621 | 564 | 11 | A | A |
| 35 | B1-3 | | 580 | 541 | 18 | 604 | 566 | 12 | A | A |
| 36 | B2-1 | | 595 | 553 | 16 | 627 | 570 | 10 | A | A |
| 37 | B3-1 | | 577 | 526 | 19 | 596 | 540 | 12 | A | A |
| 37A | B3-2 | | 585 | 536 | 17 | 610 | 552 | 11 | A | A |

TABLE 16

| Test No. | Manufacturing process | Alloy No. | Parallel to rolling direction: Tensile strength $TS_P$ (N/mm$^2$) | Parallel to rolling direction: Proof stress $YS_P$ (N/mm$^2$) | Parallel to rolling direction: Elongation (%) | Perpendicular to rolling direction: Tensile strength $TS_O$ (N/mm$^2$) | Perpendicular to rolling direction: Proof stress $YS_O$ (N/mm$^2$) | Perpendicular to rolling direction: Elongation (%) | Bending workability: Good Way (evaluation) | Bending workability: Bad Way (evaluation) |
|---|---|---|---|---|---|---|---|---|---|---|
| 41 | A1-1 | 3 | 574 | 526 | 16 | 587 | 538 | 12 | A | A |
| 42 | A1-2 | | 578 | 530 | 15 | 592 | 536 | 11 | A | A |
| 43 | A1-3 | | 582 | 533 | 13 | 595 | 540 | 10 | A | A |
| 44 | A1-4 | | 545 | 504 | 22 | 560 | 510 | 16 | A | A |
| 45 | A2-1 | | 560 | 521 | 18 | 581 | 532 | 12 | A | A |
| 46 | A2-2 | | 562 | 519 | 18 | 580 | 530 | 12 | A | A |

TABLE 16-continued

| Test No. | Manufacturing process | Alloy No. | Parallel to rolling direction: Tensile strength $TS_P$ ($N/mm^2$) | Parallel: Proof stress $YS_P$ ($N/mm^2$) | Parallel: Elongation (%) | Perpendicular to rolling direction: Tensile strength $TS_O$ ($N/mm^2$) | Perpendicular: Proof stress $YS_O$ ($N/mm^2$) | Perpendicular: Elongation (%) | Bending workability: Good Way (evaluation) | Bending: Bad Way (evaluation) |
|---|---|---|---|---|---|---|---|---|---|---|
| 47 | A2-3 | | 576 | 532 | 16 | 594 | 541 | 10 | A | A |
| 48 | A2-4 | | 558 | 520 | 17 | 580 | 512 | 11 | A | A |
| 49 | A2-5 | | 632 | 565 | 9 | 655 | 594 | 6 | B | C |
| 50 | A2-6 | | 496 | 446 | 21 | 529 | 477 | 14 | A | C |
| 51 | A2-7 | | 590 | 551 | 12 | 613 | 565 | 10 | A | A |
| 52 | A2-8 | | 596 | 556 | 12 | 626 | 580 | 9 | A | A |
| 52A | A2-9 | | 577 | 538 | 13 | 608 | 558 | 11 | A | A |
| 52B | A2-10 | | 556 | 508 | 12 | 598 | 545 | 9 | A | C |
| 52C | A2-11 | | 615 | 560 | 10 | 647 | 583 | 7 | A | C |
| 53 | B1-1 | | 556 | 517 | 18 | 581 | 534 | 12 | A | A |
| 54 | B1-2 | | 565 | 528 | 17 | 594 | 541 | 10 | A | A |
| 55 | B1-3 | | 554 | 516 | 17 | 581 | 537 | 12 | A | A |
| 56 | B2-1 | | 568 | 528 | 17 | 590 | 538 | 11 | A | A |
| 57 | B3-1 | | 550 | 511 | 18 | 577 | 526 | 13 | A | A |
| 57A | B3-2 | | 554 | 516 | 17 | 583 | 531 | 12 | A | A |

TABLE 17

| Test No. | Manufacturing process | Alloy No. | Parallel to rolling direction: Tensile strength $TS_P$ ($N/mm^2$) | Parallel: Proof stress $YS_P$ ($N/mm^2$) | Parallel: Elongation (%) | Perpendicular to rolling direction: Tensile strength $TS_O$ ($N/mm^2$) | Perpendicular: Proof stress $YS_O$ ($N/mm^2$) | Perpendicular: Elongation (%) | Bending workability: Good Way (evaluation) | Bending: Bad Way (evaluation) |
|---|---|---|---|---|---|---|---|---|---|---|
| 61 | A1-1 | 4 | 556 | 523 | 15 | 582 | 527 | 11 | A | A |
| 62 | A1-2 | | 570 | 518 | 14 | 584 | 531 | 10 | A | A |
| 63 | A1-3 | | 576 | 529 | 14 | 588 | 533 | 11 | A | A |
| 64 | A1-4 | | 540 | 501 | 20 | 556 | 506 | 14 | A | A |
| 65 | A2-1 | | 553 | 512 | 17 | 574 | 526 | 11 | A | A |
| 66 | A2-2 | | 550 | 508 | 18 | 571 | 523 | 12 | A | A |
| 67 | A2-3 | | 564 | 522 | 16 | 583 | 530 | 10 | A | A |
| 68 | A2-4 | | 544 | 508 | 16 | 567 | 502 | 10 | A | A |
| 69 | A2-5 | | 625 | 574 | 9 | 656 | 594 | 5 | A | C |
| 70 | A2-6 | | 496 | 436 | 22 | 502 | 455 | 14 | A | B |
| 71 | A2-7 | | 585 | 542 | 12 | 607 | 556 | 9 | A | A |
| 72 | A2-8 | | 593 | 547 | 11 | 618 | 563 | 8 | A | A |
| 73 | B1-1 | | 550 | 511 | 17 | 570 | 528 | 12 | A | A |
| 74 | B1-2 | | 559 | 518 | 16 | 580 | 534 | 11 | A | A |
| 75 | B1-3 | | 548 | 511 | 17 | 568 | 529 | 13 | A | A |
| 76 | B1-4 | | 516 | 458 | 16 | 571 | 503 | 9 | A | B |
| 77 | B2-1 | | 562 | 520 | 15 | 584 | 528 | 11 | A | A |
| 78 | B3-1 | | 548 | 519 | 16 | 568 | 519 | 12 | A | A |
| 78B | B3-2 | | 553 | 522 | 16 | 575 | 527 | 12 | A | A |

TABLE 18

| Test No. | Manufacturing process | Alloy No. | Parallel to rolling direction: Tensile strength $TS_P$ ($N/mm^2$) | Parallel: Proof stress $YS_P$ ($N/mm^2$) | Parallel: Elongation (%) | Perpendicular to rolling direction: Tensile strength $TS_O$ ($N/mm^2$) | Perpendicular: Proof stress $YS_O$ ($N/mm^2$) | Perpendicular: Elongation (%) | Bending workability: Good Way (evaluation) | Bending: Bad Way (evaluation) |
|---|---|---|---|---|---|---|---|---|---|---|
| 101 | C1 | 11 | 591 | 548 | 17 | 608 | 564 | 11 | A | A |
| 102 | C1 | 12 | 602 | 558 | 15 | 622 | 576 | 9 | A | B |
| 103 | C1 | 13 | 593 | 550 | 16 | 611 | 566 | 10 | A | B |
| 103A | C1A | 13 | 596 | 553 | 16 | 614 | 569 | 10 | A | B |
| 104 | C1 | 14 | 598 | 545 | 15 | 605 | 561 | 9 | A | B |
| 105 | C1 | 15 | 592 | 548 | 17 | 607 | 563 | 11 | A | A |
| 106 | C1 | 16 | 584 | 543 | 18 | 605 | 558 | 12 | A | A |
| 106A | C1A | 16 | 585 | 545 | 18 | 602 | 557 | 13 | A | A |
| 107 | C1 | 17 | 580 | 541 | 18 | 598 | 546 | 12 | A | A |

TABLE 18-continued

| Test No. | Manufacturing process | Alloy No. | Parallel to rolling direction: Tensile strength $TS_P$ ($N/mm^2$) | Parallel: Proof stress $YS_P$ ($N/mm^2$) | Parallel: Elongation (%) | Perpendicular to rolling direction: Tensile strength $TS_O$ ($N/mm^2$) | Perpendicular: Proof stress $YS_O$ ($N/mm^2$) | Perpendicular: Elongation (%) | Bending workability: Good Way (evaluation) | Bending workability: Bad Way (evaluation) |
|---|---|---|---|---|---|---|---|---|---|---|
| 108 | C1 | 18 | 586 | 545 | 16 | 606 | 560 | 10 | A | A |
| 109 | C1 | 19 | 552 | 513 | 19 | 570 | 525 | 12 | A | A |
| 110 | C1 | 20 | 510 | 478 | 20 | 519 | 480 | 13 | A | A |
| 111 | C1 | 21 | 533 | 498 | 19 | 544 | 502 | 12 | A | A |
| 112 | C1 | 22 | 562 | 523 | 17 | 587 | 540 | 11 | A | A |
| 112A | C1A | 22 | 567 | 526 | 17 | 590 | 544 | 12 | A | A |
| 113 | C1 | 23 | 557 | 519 | 18 | 584 | 537 | 12 | A | A |

TABLE 19

| Test No. | Manufacturing process | Alloy No. | Parallel to rolling direction: Tensile strength $TS_P$ ($N/mm^2$) | Parallel: Proof stress $YS_P$ ($N/mm^2$) | Parallel: Elongation (%) | Perpendicular to rolling direction: Tensile strength $TS_O$ ($N/mm^2$) | Perpendicular: Proof stress $YS_O$ ($N/mm^2$) | Perpendicular: Elongation (%) | Bending workability: Good Way (evaluation) | Bending workability: Bad Way (evaluation) |
|---|---|---|---|---|---|---|---|---|---|---|
| 114 | C1 | 11 | 591 | 547 | 16 | 613 | 566 | 11 | A | A |
| 115 | C1 | 12 | 601 | 554 | 15 | 620 | 571 | 10 | A | A |
| 116 | C1 | 13 | 597 | 554 | 16 | 619 | 571 | 10 | A | A |
| 116A | C1A | 26 | 602 | 560 | 16 | 622 | 574 | 10 | A | A |
| 117 | C1 | 14 | 593 | 547 | 17 | 613 | 565 | 11 | A | A |
| 118 | C1 | 15 | 597 | 552 | 15 | 619 | 568 | 10 | A | A |
| 119 | C1 | 16 | 585 | 542 | 17 | 613 | 564 | 11 | A | A |
| 120 | C1 | 17 | 593 | 551 | 16 | 618 | 568 | 11 | A | A |
| 121 | C1 | 18 | 588 | 546 | 17 | 609 | 560 | 11 | A | A |
| 122 | C1 | 19 | 591 | 551 | 16 | 614 | 565 | 11 | A | A |
| 123 | C1 | 20 | 589 | 548 | 16 | 612 | 563 | 11 | A | A |
| 124 | C1 | 21 | 583 | 544 | 17 | 607 | 556 | 11 | A | A |
| 125 | C1 | 22 | 579 | 537 | 16 | 602 | 553 | 10 | A | A |
| 126 | C1 | 23 | 590 | 546 | 17 | 614 | 564 | 11 | A | A |

TABLE 20

| Test No. | Manufacturing process | Alloy No. | Parallel to rolling direction: Tensile strength $TS_P$ ($N/mm^2$) | Parallel: Proof stress $YS_P$ ($N/mm^2$) | Parallel: Elongation (%) | Perpendicular to rolling direction: Tensile strength $TS_O$ ($N/mm^2$) | Perpendicular: Proof stress $YS_O$ ($N/mm^2$) | Perpendicular: Elongation (%) | Bending workability: Good Way (evaluation) | Bending workability: Bad Way (evaluation) |
|---|---|---|---|---|---|---|---|---|---|---|
| 201 | C1 | 101 | 580 | 528 | 14 | 619 | 555 | 10 | A | B |
| 201A | C1A | 101 | 588 | 536 | 12 | 628 | 563 | 9 | A | C |
| 202 | C1 | 102 | 574 | 526 | 18 | 603 | 546 | 11 | A | A |
| 203 | C1 | 103 | 543 | 492 | 19 | 565 | 507 | 13 | A | A |
| 204 | C1 | 104 | 608 | 552 | 11 | 637 | 566 | 7 | B | C |
| 205 | C1 | 105 | 611 | 554 | 12 | 640 | 568 | 8 | B | C |
| 206 | C1 | 106 | 608 | 550 | 12 | 638 | 566 | 7 | B | C |
| 207 | C1 | 107 | 614 | 563 | 14 | 645 | 578 | 8 | A | C |
| 208 | C1 | 108 | 592 | 545 | 16 | 617 | 554 | 10 | A | C |
| 209 | C1 | 109 | 595 | 536 | 15 | 627 | 564 | 9 | A | C |
| 210 | C1 | 110 | 579 | 530 | 17 | 606 | 542 | 10 | A | A |
| 211 | C1 | 111 | 553 | 508 | 18 | 581 | 533 | 12 | A | A |
| 211A | C1A | 111 | 550 | 506 | 18 | 579 | 530 | 13 | A | A |
| 212 | C1 | 112 | 494 | 445 | 17 | 486 | 440 | 12 | A | A |
| 213 | C1 | 113 | 597 | 552 | 13 | 627 | 563 | 10 | A | B |
| 214 | C1 | 114 | 557 | 505 | 19 | 579 | 519 | 13 | A | A |
| 215 | C1 | 115 | 605 | 546 | 12 | 637 | 563 | 8 | A | C |
| 216 | C1 | 116 | 567 | 525 | 19 | 589 | 541 | 13 | A | A |
| 217 | C1 | 117 | 564 | 524 | 19 | 586 | 538 | 13 | A | A |

TABLE 21

| Test No. | Manufacturing process | Alloy No. | Parallel to rolling direction: Tensile strength $TS_P$ (N/mm$^2$) | Parallel: Proof stress $YS_P$ (N/mm$^2$) | Parallel: Elongation (%) | Perpendicular to rolling direction: Tensile strength $TS_O$ (N/mm$^2$) | Perpendicular: Proof stress $YS_O$ (N/mm$^2$) | Perpendicular: Elongation (%) | Bending workability: Good Way (evaluation) | Bending workability: Bad Way (evaluation) |
|---|---|---|---|---|---|---|---|---|---|---|
| 218 | C1 | 118 | 659 | 606 | 8 | 683 | 620 | 5 | B | C |
| 219 | C1 | 119 | 654 | 603 | 11 | 678 | 616 | 6 | A | C |
| 220 | C1 | 120 | 599 | 543 | 12 | 630 | 558 | 8 | A | B |
| 220A | C1A | 120 | 606 | 548 | 11 | 639 | 568 | 7 | A | C |
| 221 | C1 | 121 | 602 | 547 | 12 | 633 | 562 | 9 | A | B |
| 221A | C1A | 121 | 607 | 551 | 11 | 641 | 570 | 8 | A | C |
| 301 | C2 | 201 | 522 | 481 | 14 | 553 | 490 | 10 | A | B |
| 302 | C2 | 202 | 517 | 480 | 15 | 544 | 488 | 11 | A | B |
| 303 | C2 | 203 | 497 | 469 | 15 | 515 | 477 | 11 | A | A |
| 304 | C2 | 204 | 469 | 445 | 13 | 582 | 456 | 10 | A | A |
| 305 | — | 205 | 622 | 558 | 25 | 647 | 572 | 18 | A | B |

From the above-described evaluation results, characteristics with a composition and a composition relational expression were confirmed as follows.

(1) The Zn content was greater than 30% by mass, the bending workability deteriorated, and the stress relaxation characteristics, the stress corrosion cracking resistance, and the discoloration resistance deteriorated. Particularly, when the Zn content was less than 29% by mass, the bending workability were further improved, and the stress relaxation characteristics, the stress corrosion cracking resistance, and the discoloration resistance were improved. When the Zn content was less than 18% by mass, the strength was lowered, and the discoloration resistance also deteriorated. When the Zn content was 19% by mass or greater, the strength was further raised. (Refer to Test Nos. 201, 201A, 213, 33, 212, 73, and the like)

(2) When the Ni content was less than 1% by mass, the stress relaxation characteristics, the stress corrosion cracking resistance, and the discoloration resistance deteriorated. When the Ni content was greater than 1.1% by mass, the stress relaxation characteristics, the stress corrosion cracking resistance, and the discoloration resistance were further improved. (Refer to Test Nos. 210, 211, 13, and the like)

(3) When the Sn content was less than 0.2% by mass, the strength and the stress relaxation characteristics deteriorated. When the Sn content was 0.3% by mass or greater, the strength and the stress relaxation characteristics were improved. When the Sn content was greater than 1% by mass, the β-phase and the γ-phase was likely to occur, and thus the bending workability and the ductility deteriorated, and the stress relaxation characteristics and the stress corrosion cracking resistance deteriorated. (Refer to Test Nos. 203, 204, 53, and the like)

(4) When the P content was less than 0.003% by mass, the stress relaxation characteristics and the stress corrosion cracking resistance deteriorated. The operation of suppressing grain growth is not effective, and thus a grain becomes large, and the strength is lowered. When the P content was greater than 0.06% by mass, the bending workability deteriorated. (Refer to Test Nos. 217, 207, 33, and the like)

(5) A value of the relational expression $f1=[Zn]+5\times[Sn]-2\times[Ni]$ was greater than 30, the β-phase and the γ-phase other than the α-phase were shown, and thus the bending workability, the stress relaxation characteristics, the stress corrosion cracking resistance, and the discoloration resistance deteriorated. In addition, it could be seen that the value of the relational expression $f1=[Zn]+5\times[Sn]-2\times[Ni]$ is a boundary value determining whether the bending workability, the stress relaxation characteristics, the stress corrosion cracking resistance, and the discoloration resistance are good or bad. In addition, when the value of the relational expression f1 was less than 17, the strength was lowered. When the value of the relational expression f1 was 18 or greater or 20 or greater, the strength was further raised. (Refer to Test Nos. 205, 206, 215, 220, 101, 103, 13, 213, 212, 110, 73, and the like)

(6) When a value of the relational expression $f2=[Zn]-0.5\times[Sn]-3\times[Ni]$ was greater than 26, the stress corrosion cracking resistance deteriorated. In addition, when the value was 25.5 or less, the stress corrosion cracking resistance was further improved. In addition, when the value was less than 14, the strength was lowered, and when the value was 15 or greater, the strength was further raised (refer to Test Nos. 216, 215, 214, 213, and the like). Further, in the Cu—Zn alloy (Test Nos. 301 to 304), the stress corrosion cracking depended on the Zn content, and the Zn content of approximately 25% by mass became a boundary content determining whether or not the alloy capable of enduring the stress corrosion cracking in a severe environment.

(7) When a value of the relational expression $f3=\{f1\times(32-f1)\}^{1/2}\times[Ni]$ was less than 8, the stress relaxation characteristics deteriorated. When this value was greater than 10, the stress relaxation characteristics were further improved (refer to Test Nos. 115, 206, 101, 23, and the like).

(8) The discoloration resistance was improved due to an effect obtained when Ni and Sn were contained, but the value of the relational expression $f4=[Ni]+[Sn]$ was less than 1.3, and the discoloration resistance and the stress relaxation characteristics deteriorated. When the value was greater than 1.4, the discoloration resistance and the stress relaxation characteristics were further improved (refer to Test Nos. 214, 111, 33, 211, and the like).

(9) When a value of the relational expression $f5=[Ni]/[Sn]$ was less than 1.5 or greater than 5.5, the stress relaxation characteristics deteriorated. In addition, when the value was 1.7 or greater or less than 4.5, the stress relaxation characteristics were improved (refer to Test Nos. 209, 214, 204, 216, 220, 221, 108, 109, 73, 53, and the like). When the value of the relational expression $f5=[Ni]/[Sn]$ was less than 1.5, the β-phase and the γ-phase were likely to exist, and thus the bending workability deteriorated, and the stress relaxation characteristics and the stress corrosion cracking resistance deteriorated (refer to Test Nos. 220, 221, 204, 209, 220A, 221A, and the like).

(10) When a value of the relational expression f6=[Ni]/[P] was less than 20 or greater than 400, the stress relaxation characteristics deteriorated. When the value was 25 to 250, and 100 or less, the stress relaxation characteristics were further improved. In addition, when the value of f6 was less than 20, the bending workability deteriorated (refer to Test Nos. 207, 208, 217, 101, and the like).

(11) When at least one or more kinds of elements selected from the groups consisting of Al, Fe, Co, Mg, Mn, Ti, Zr, Cr, Si, Sb, As, Pb, and rare-earth elements were contained in a total amount of 0.0005% by mass to 0.2% by mass and each element was contained in an amount of 0.0005% by mass to 0.05% by mass, a grain became fine, and thus the strength was slightly raised (refer to Test Nos. 114 to 123).

(12) When Fe and Co were contained in an amount greater than 0.05% by mass, an average particle size of the precipitates became smaller than 3 nm, and thus the strength was raised, but the bending workability and the stress relaxation characteristics deteriorated (refer to Test Nos. 218 and 219).

(13) When the Sn content was greater than 1% by mass, the P content was greater than 0.06% by mass, and the value of f6=[Ni]/[P] was less than 20 or the value of f1=[Zn]+5×[Sn]−2×[Ni] was greater than 30, the proof stress/the tensile strength in a direction perpendicular to the rolling direction became smaller than 0.9 (refer to Test Nos. 204 to 207, 215, 101, and the like).

In addition, from the above-described evaluation results, with regard to a manufacturing process and characteristics, the following confirmation was obtained.

(1) In an actual production facility, even when the number of times of annealing is two times or three times including final annealing (Process A1-2, Process A2-1, and the like), even when the final annealing method is a continuous annealing method and a batch method (Process A2-1, Process A2-2, and the like), even when the recovery heat treatment is a batch executed in a laboratory, even in a continuous annealing method (Process A1-1, Process A1-2, Process A1-3, and the like), if the highest arrival temperature Tmax is appropriate, and a numerical value of the index It is in an appropriate range, the strength, the bending workability, the discoloration resistance, the stress relaxation characteristics, and the stress corrosion cracking resistance, which are targeted in the invention, were obtained. When the recovery heat treatment was carried out, the proof stress/the tensile strength increased (Process A2-2, Process A2-4, and the like).

(2) The above-described characteristics obtained from the actual production facility, and characteristics experimented upon in the process B that was carried out with a small piece were substantially the same as each other (Process A2-1, Process B1-1, and the like). Particularly, results of the continuous annealing method in the actual production facility, and characteristics obtained in an experiment in which the continuous annealing method was substituted with a salt bath were approximately the same as each other (Process A2-3, Process B1-2, and the like).

(3) In a test at a laboratory with a small piece, even when the final annealing or the recovery heat treatment was the continuous annealing method or the batch method (Process B1-1 and Process B1-3), the strength, the bending workability, the discoloration resistance, the stress relaxation characteristics, and the stress corrosion cracking resistance, which are targeted in the invention, were obtained.

(4) From the alloy of the invention which was examined through annealing once, only finish annealing without annealing, or annealing and cold-rolling which were repeated without a hot-rolling process by using a small piece sample in the process B, similar to the above-described characteristics obtained from the actual production facility in the invention, a copper alloy sheet having the characteristics which were targeted was obtained (Process B1-1, Process B2-1, Process B3-1, Process A1-1, and Process A2-1).

In Process B3-1 and Process B3-2 in which hot-rolling was not carried out, even when the final annealing was either the batch type or the high-temperature and short-time type, in the alloy of the invention, the stress relaxation characteristics were slightly more satisfactory in the case of the high-temperature and short-time type, but approximately the same characteristics were obtained.

(5) With regard to the stress relaxation characteristics, in a case where the final annealing was carried out with the continuous high-temperature and short-time annealing method, the stress relaxation characteristics were slightly more satisfactory in comparison to the batch type annealing method (Process A1-2, Process A1-4, Process A2-1, Process A2-2, and the like). In the case where the final annealing was carried out with the batch type, it is considered that precipitates of Ni and P increase, and this has an effect on a balance between Ni and P which are in a solid-solution state, and precipitates of Ni and P. When both annealing before final annealing and the final annealing were carried out with the continuous high-temperature and short-time annealing method, the stress relaxation characteristics were slightly satisfactory (Process A2-9). There was almost no difference in the recovery heat treatment between the batch type (retention at 300° C. for 30 minutes), and the continuous high-temperature and short-time type (450° C.-0.05 minutes) (Process A1-1, Process A1-2, and the like).

(6) In the recovery heat treatment (300° C.-0.07 minutes) and (250° C.-0.15 minutes) on the assumption of the melting Sn-plating, strength was slightly higher, an elongation value was lower, and an effective stress value at 150° C. in the stress relaxation characteristics slightly deteriorated in comparison to other recovery heat treatment conditions, but characteristics which were targeted in the invention could be accomplished (Process A1-1, Process A1-2, Process A1-3, and the like).

(7) In a case where a final annealing temperature was low, the size of a grain became fine, and when an average grain size was smaller than 2 μm, the strength (the tensile strength, the proof stress) was improved, but the bending workability deteriorated, and the stress relaxation characteristics slightly deteriorated (Process A2-1, Process A2-5, Process A2-11, and Process A2-2, and the like).

(8) When the final annealing temperature was high, the size of the grain increased, and when the average grain size was greater than 12 μm, the strength was lowered, the stress relaxation characteristics slightly deteriorated, and the effective stress at 150° C. was lowered. In addition, due to the batch type, the metallographic structure entered in a mixed-in state, and thus anisotropy in mechanical properties increased, and the bending workability and the stress corrosion cracking resistance deteriorated (Process A2-6).

(9) When the final annealing was carried out with the continuous annealing method, even though the average grain size was as slightly large as 5 μm to 9 μm, the mixing-in did not occur, and only uniform recrystallized grains existed, and thus the stress relaxation characteristics and the bending workability were satisfactory (Process A1-4, Process A2-7, Process A2-9, and the like).

(10) When the Zn content and the Sn content were large, the value of f1 was large, and the value of f5 was small, the β-phase and the γ-phase were likely to remain in the metallographic structure, and thus the stress relaxation characteristics, the bending workability, and the stress corrosion cracking resistance deteriorated (Test Nos. 201, 204, 205, 213, 215, 220, and the like).

(11) In a case of carrying out the final annealing with the continuous annealing method, when the Zn content and the Sn content were great, the value of f1 was large, and the value of f5 was small, the β-phase and the γ-phase were likely to be more abundant in the metallographic structure, and thus the stress relaxation characteristics, the bending workability, the stress corrosion cracking resistance, and the discoloration resistance deteriorated (Test Nos. 201A, 220A, 221A, and the like).

(12) When a grain size after the final annealing was set to D1, a grain size after an annealing process immediately before the final annealing was set to D0, and a cold reduction in cold-rolling before finish was set to RE (%), if $D0 \leq D1 \times 6 \times (RE/100)$ was not satisfied, the strength was low, the proof stress/the tensile strength was lowered, and a ratio of the tensile strength and a ratio of the proof stress between a direction parallel to the rolling direction and a direction perpendicular to the rolling direction decreased, respectively, and thus the bending workability and the stress relaxation characteristics deteriorated. A target process is B1-4, the grain size after the annealing before the final annealing was 40 μm, a grain size after the final annealing enters a mixed-in state was 6 μm and 7 μm, and the relational expression was not satisfied. In Process B1-3, a grain size after the annealing before the final annealing was 10 μm, a grain size after the final annealing was 4 μm, and the relational repression was satisfied. Accordingly, the strength and the bending workability were excellent, the proof stress/the tensile strength was raised, and the stress relaxation characteristics were excellent.

(13) In Process A2-7, Process A2-8, and Process A2-9 in which the average grain size was as slightly large as 5 μm to 9 μm, a final reduction was 25%, but the strength was slightly high, and the bending workability, the stress relaxation characteristics, and the stress corrosion cracking resistance were satisfactory.

When a size of precipitate particles was smaller than 3 nm or greater than 180 nm, the stress relaxation characteristics and the bending workability deteriorated (Test Nos. 10, 30, 50, 218, 219, and the like).

Hereinbefore, according to the copper alloy of the invention, it was confirmed that the discoloration resistance was excellent, the strength was high, the bending workability was satisfactory, the stress relaxation characteristics were excellent, and the stress corrosion cracking resistance became satisfactory.

INDUSTRIAL APPLICABILITY

According to the copper alloy and the copper alloy sheet formed from the copper alloy of the invention, the copper alloy and the copper alloy sheet are excellent in the cost performance, and have a small density, conductivity greater than that of phosphorus bronze or nickel silver, and high strength. In addition, the copper alloy and the copper alloy sheet are excellent in a balance between strength, elongation, bending workability, and conductivity, stress relaxation characteristics, stress corrosion cracking resistance, discoloration resistance, and antimicrobial properties. Accordingly, the copper alloy and the copper alloy sheet are capable of coping with various use environments.

The invention claimed is:

1. A copper alloy, containing:

18% by mass to less than 27.8% by mass of Zn;

1% by mass to 1.5% by mass of Ni;

0.2% by mass to 1% by mass of Sn; and 0.003% by mass to 0.06% by mass of P, the remainder including Cu and unavoidable impurities, wherein a Zn content [Zn] in terms of % by mass, a Sn content [Sn] in terms of % by mass, and a Ni content [Ni] in terms of % by mass satisfy relationships of $17 \leq f1 = [Zn] + 5 \times [Sn] - 2 \times [Ni] \leq 29$, $14 \leq f2 = [Zn] - 0.5 \times [Sn] - 3 \times [Ni] \leq 26$, and $8 \leq f3 = \{f1 \times (32 - f1)\}^{1/2} \times [Ni] \leq 23$, the Sn content [Sn] in terms of % by mass, and the Ni content [Ni] in terms of % by mass satisfy relationships of $1.3[Ni] + [Sn] \leq 2.4$, and $1.5 \leq [Ni]/[Sn] \leq 5.5$, the Ni content [Ni] in terms of % by mass, and a P content [P] in terms of % by mass satisfy a relationship of $20 \leq [Ni]/[P] \leq 400$, and the copper alloy has a metallographic structure of an α single phase.

2. The copper alloy according to claim 1, wherein conductivity is 18% IACS to 27% IACS, an average gain size is 2 μm to 12 μm, and circular or elliptical precipitates exist, and an average particle size of the precipitates is 3 nm to 180 nm, or a proportion of the number of precipitates having a particle size of 3 nm to 180 nm among the precipitates is 70% or greater.

3. The copper alloy according to claim 1, wherein the copper alloy is used in parts of electronic and electrical apparatuses of a connector, a terminal, a relay, and a switch.

4. A copper alloy, containing:

19% by mass to less than 27.8% by mass of Zn;

1% by mass to 1.5% by mass of Ni;

0.3% by mass to 1% by mass of Sn; and 0.005% by mass to 0.06% by mass of P, the remainder including Cu and unavoidable impurities, wherein a Zn content [Zn] in terms of % by mass, a Sn content [Sn] in terms of % by mass, and a Ni content [Ni] in terms of % by mass satisfy relationships of $18 \leq f1 = [Zn] + 5 \times [Sn] - 2 \times [Ni] \leq 27.81$, $15 \leq f2 = [Zn] - 0.5 \times [Sn] - 3 \times [Ni] \leq 25.5$, and $9 \leq f3 = \{f1 \times (32 - f1)\}^{1/2} \times [Ni] \leq 22$, the Sn content [Sn] in terms of % by mass, and the Ni content [Ni] in terms of % by mass satisfy relationships of $1.4 \leq [Ni] + [Sn] \leq 2.4$, and $1.7 \leq [Ni]/[Sn] \leq 4.5$, the Ni content [Ni] in terms of % by mass, and a P content [P] in terms of % by mass satisfy a relationship of $22 \leq [Ni]/[P] \leq 220$, and the copper alloy has a metallographic structure of an α single phase.

5. The copper alloy according to claim 4, wherein conductivity is 18% IACS to 27% IACS, an average gain size is 2 μm to 12 μm, and circular or elliptical precipitates exist, and an average particle size of the precipitates is 3 nm to 180 nm, or a proportion of the number of precipitates having a particle size of 3 nm to 180 nm among the precipitates is 70% or greater.

6. The copper alloy according to claim 4, wherein the copper alloy is used in parts of electronic and electrical apparatuses of a connector, a terminal, a relay, and a switch.

7. A copper alloy, containing:

18% by mass to less than 27.8% by mass by mass of Zn;

1% by mass to 1.5% by mass of Ni;

0.2% by mass to 1% by mass of Sn;

0.003% by mass to 0.06% by mass of P; and one or more elements selected from Al, Fe, Co, Mg, Mn, Ti, Zr, Cr, Si, Sb, As, Pb, and rare-earth elements, each element being contained in an amount of 0.0005% by mass to 0.05% by mass, and a total amount of the elements being 0.0005% by mass to 0.2% by mass; and the remainder including Cu and unavoidable impurities, wherein a Zn content [Zn] in terms of % by mass, a Sn content [Sn] in terms of % by mass, and a Ni content [Ni] in terms of % by mass satisfy relationships of $17 \leq f1 = [Zn] + 5 \times [Sn] - 2 \times [Ni] \leq 29$, $14 \leq f2 = [Zn] - 0.5 \times [Sn] - 3 \times [Ni] \leq 26$, and $8 \leq f3 = \{f1 \times (32 - f1)\}^{1/2} \times [Ni] \leq 23$, the Sn content [Sn] in terms of % by mass, and the Ni content [Ni] in terms of % by mass satisfy relationships of $1.3 \leq [Ni] + [Sn] \leq 2.4$, and $1.5 \leq [Ni]/[Sn] \leq 5.5$, the Ni content [Ni] in terms of % by mass, and a P content [P] in terms of % by mass satisfy a relationship of $20 \leq [Ni]/[P] \leq 400$, and the copper alloy has a metallographic structure of an $\alpha$ single phase.

8. The copper alloy according to claim 7, wherein conductivity is 18% IACS to 27% IACS, an average gain size is 2 μm to 12 μm, and circular or elliptical precipitates exist, and an average particle size of the precipitates is 3 nm to 180 nm, or a proportion of the number of precipitates having a particle size of 3 nm to 180 nm among the precipitates is 70% or greater.

9. The copper alloy according to claim 7, wherein the copper alloy is used in parts of electronic and electrical apparatuses of a connector, a terminal, a relay, and a switch.

* * * * *